US010538103B2

(12) United States Patent
Jeuté et al.

(10) Patent No.: US 10,538,103 B2
(45) **Date of Patent: *Jan. 21, 2020**

(54) DROP ON DEMAND PRINTING HEAD AND PRINTING METHOD

(71) Applicant: Piotr Jeuté, Menlo Park, CA (US)

(72) Inventors: Piotr Jeuté, Warsaw (PL); Maciej Zawadzki, Warsaw (PL)

(73) Assignee: Piotr Jeuté, Warsaw (PL)

( * ) Notice: Subject to any disclaimer, the term of this patent is extended or adjusted under 35 U.S.C. 154(b) by 0 days.

This patent is subject to a terminal disclaimer.

(21) Appl. No.: 15/552,275

(22) PCT Filed: Feb. 26, 2016

(86) PCT No.: PCT/EP2016/054093
§ 371 (c)(1),
(2) Date: Aug. 19, 2017

(87) PCT Pub. No.: WO2016/135296
PCT Pub. Date: Sep. 1, 2016

(65) Prior Publication Data

US 2018/0244040 A1 Aug. 30, 2018

(30) Foreign Application Priority Data

Dec. 24, 2015 (EP) ..... 15202657

(51) Int. Cl.
*B41J 2/21* (2006.01)
*B41J 2/03* (2006.01)
(Continued)

(52) U.S. Cl.
CPC ..... *B41J 2/211* (2013.01); *B41J 2/03* (2013.01); *B41J 2/04581* (2013.01);
(Continued)

(58) Field of Classification Search
CPC . B41J 2/211; B41J 2/04581; B41J 2/03; B41J 2/04595; B41J 2/09; B41J 2002/022;
(Continued)

(56) References Cited

U.S. PATENT DOCUMENTS

2003/0080208 A1* 5/2003 Williams ..... B41J 2/14008 239/300
2004/0263547 A1* 12/2004 Sugahara ..... B41J 2/04526 347/9

(Continued)

FOREIGN PATENT DOCUMENTS

JP 11227192 A * 8/1999

*Primary Examiner* — Justin Seo
(74) *Attorney, Agent, or Firm* — Soody Tronson; STLG Law Firm

(57) ABSTRACT

A drop-on-demand printing method comprising performing the following steps in a printing head: discharging a first primary drop (x21A) of a first liquid to move along a first path; discharging a second primary drop (x21B) of a second liquid to move along a second path; controlling the flight of the first primary drop (x21A) and the second primary drop (x21B) to combine the first primary drop with the second primary drop into a combined drop (x22) at a connection point (x32) within a reaction chamber within the printing head so that a chemical reaction is initiated within a controlled environment of the reaction chamber between the first liquid of the first primary drop and the second liquid of the second primary drop; and controlling the flight of the combined drop (x22) at least by means of a stream of gas (x71A, x71B).

15 Claims, 22 Drawing Sheets

(51) Int. Cl.
*B41J 2/045* (2006.01)
*B41J 2/09* (2006.01)
*B41J 2/02* (2006.01)

(52) U.S. Cl.
CPC ..... *B41J 2/04595* (2013.01); *B41J 2/09* (2013.01); *B41J 2002/022* (2013.01); *B41J 2002/031* (2013.01); *B41J 2202/02* (2013.01); *B41J 2202/16* (2013.01)

(58) Field of Classification Search
CPC ..... B41J 2002/031; B41J 2202/16; B41J 2202/02
See application file for complete search history.

(56) References Cited

U.S. PATENT DOCUMENTS

| | | | | |
|---|---|---|---|---|
| 2009/0181182 | A1* | 7/2009 | Sloan | C09D 11/101 427/508 |
| 2010/0277529 | A1* | 11/2010 | Xie | B41J 2/03 347/12 |
| 2013/0016145 | A1* | 1/2013 | Gerstenberger | B41J 2/02 347/10 |
| 2013/0235101 | A1* | 9/2013 | Grace | B41J 2/03 347/10 |

* cited by examiner

DROP ON DEMAND PRINTING HEAD AND PRINTING METHOD

TECHNICAL FIELD

The present invention relates to drop on demand printing heads and printing methods.

BACKGROUND

Ink jet printing is a type of printing that recreates a digital image by propelling drops of ink onto paper, plastic, or other substrates. There are two main technologies in use: continuous (CIJ) and Drop-on-demand (DOD) inkjet.

In continuous inkjet technology, a high-pressure pump directs the liquid solution of ink and fast drying solvent from a reservoir through a gunbody and a microscopic nozzle, creating a continuous stream of ink drops via the Plateau-Rayleigh instability. A piezoelectric crystal creates an acoustic wave as it vibrates within the gunbody and causes the stream of liquid to break into drops at regular intervals. The ink drops are subjected to an electrostatic field created by a charging electrode as they form; the field varies according to the degree of drop deflection desired. This results in a controlled, variable electrostatic charge on each drop. Charged drops are separated by one or more uncharged "guard drops" to minimize electrostatic repulsion between neighboring drops. The charged drops pass through an electrostatic field and are directed (deflected) by electrostatic deflection plates to print on the receptor material (substrate), or allowed to continue on undeflected to a collection gutter for re-use. The more highly charged drops are deflected to a greater degree. Only a small fraction of the drops is used to print, the majority being recycled. The ink system requires active solvent regulation to counter solvent evaporation during the time of flight (time between nozzle ejection and gutter recycling), and from the venting process whereby gas that is drawn into the gutter along with the unused drops is vented from the reservoir. Viscosity is monitored and a solvent (or solvent blend) is added to counteract solvent loss.

Drop-on-demand (DOD) may be divided into low resolution DOD printers using electro valves in order to eject comparatively big drops of inks on printed substrates, or high resolution DOD printers, may eject very small drops of ink by means of using either a thermal DOD and piezoelectric DOD method of discharging the drop.

In the thermal inkjet process, the print cartridges contain a series of tiny chambers, each containing a heater. To eject a drop from each chamber, a pulse of current is passed through the heating element causing a rapid vaporization of the ink in the chamber to form a bubble, which causes a large pressure increase, propelling a drop of ink onto the paper. The ink's surface tension, as well as the condensation and thus contraction of the vapor bubble, pulls a further charge of ink into the chamber through a narrow channel attached to an ink reservoir. The inks used are usually water-based and use either pigments or dyes as the colorant. The inks used must have a volatile component to form the vapor bubble, otherwise drop ejection cannot occur.

Piezoelectric DOD use a piezoelectric material in an ink-filled chamber behind each nozzle instead of a heating element. When a voltage is applied, the piezoelectric material changes shape, which generates a pressure pulse in the fluid forcing a drop of ink from the nozzle. A DOD process uses software that directs the heads to apply between zero to eight drops of ink per dot, only where needed.

High resolution printers, alongside the office applications, are also being used in some applications of industrial coding and marking. Thermal Ink Jet more often is used in cartridge based printers mostly for smaller imprints, for example in pharmaceutical industry. Piezoelectric printheads of companies like Spectra or Xaar have been successfully used for high resolution case coding industrial printers.

All DOD printers share one feature in common: the discharged drops of ink have longer drying time compared to CIJ technology when applied on non porous substrate. The reason being usage of fast drying solvent, which is well accepted by CIJ technology designed with fast drying solvent in mind, but which usage needs to be limited in DOD technology in general and high resolution DOD in particular. That is because fast drying inks would cause the dry back on the nozzles. In most of known applications the drying time of high resolution DOD printers' imprints on non porous substrates would be at least twice and usually well over three times as long as that of CIJ. This is a disadvantage in certain industrial coding applications, for instance very fast production lines where drying time of few seconds may expose the still wet (not dried) imprint for damage when it gets in contact with other objects.

Another disadvantage of high resolution DOD technology is limited drop energy, which requires the substrate to be guided very evenly and closely to printing nozzles. This also proves to be disadvantageous for some industrial applications. For example when coded surface is not flat, it cannot be guided very close to nozzles.

CIJ technology also proves to have inherent limitations. So far CIJ has not been successfully used for high resolution imprints due to the fact that it needs certain drop size in order to work well. The other well-known disadvantage of CIJ technology is high usage of solvent. This causes not only high costs of supplies, but also may be hazardous for operators and the environment, since most efficient solvents are poisonous, such as the widely used MEK (Methyl Ethyl Ketone).

The following documents illustrate various improvements to the ink jet printing technology.

An article "Double-shot inkjet printing of donor-acceptor-type organic charge-transfer complexes: Wet/nonwet definition and its use for contact engineering" by T. Hasegawa et al (Thin Solid Films 518 (2010) pp. 3988-3991) presents a double-shot inkjet printing (DS-IJP) technique, wherein two kinds of picoliter-scale ink drops including soluble component donor (e.g. tetrathiafulvalene, TTF) and acceptor (e.g. tetracyanoquinodimethane, TCNQ) molecules are individually deposited at an identical position on the substrate surfaces to form hardly soluble metal compound films of TTF-TCNQ. The technique utilizes the wet/nonwet surface modification to confine the intermixed drops of individually printed donor and acceptor inks in a predefined area, which results in the picoliter-scale instantaneous complex formation.

A U.S. Pat. No. 7,429,100 presents a method and a device for increasing the number of ink drops in an ink drop jet of a continuously operating inkjet printer, wherein ink drops of at least two separately produced ink drop jets are combined into one ink drop jet, so that the combined ink drop jet fully encloses the separate ink drops of the corresponding separate ink drop jets and therefore has a number of ink drops equal to the sum of the numbers of ink drops in the individual stream. The drops from the individual streams do not collide with each other and are not combined with each other, but remain separate drops in the combined drop jet.

A US patent application US20050174407 presents a method for depositing solid materials, wherein a pair of inkjet printing devices eject ink drops respectively in a direction such that they coincide during flight, forming mixed drops which continue onwards towards a substrate, wherein the mixed drops are formed outside the printing head.

A Japanese patent application JP2010105163A discloses a nozzle plate that includes a plurality of nozzle holes that discharge liquids that combine in flight outside the nozzle plate.

A U.S. Pat. No. 8,092,003 presents systems and methods for digitally printing images onto substrates using digital inks and catalysts which initiate and/or accelerate curing of the inks on the substrates. The ink and catalyst are kept separate from each other while inside the heads of an inkjet printer and combine only after being discharged from the head, i.e. outside the head. This may cause problems in precise control of coalescence of the drops in flight outside the head and corresponding lack of precise control over drop placement on the printed object.

There are known various arrangements for altering the velocity of the drop exiting the printing head by using electrodes for affecting charged drops, as described e.g. in patent documents U.S. Pat. No. 3,657,599, US20110193908 or US20080074477.

The US patent application US20080074477 discloses a system for controlling drop volume in continuous ink-jet printer, wherein a succession of ink drops, all ejected from a single nozzle, are projected along a longitudinal trajectory at a target substrate. A group of drops is selected from the succession in the trajectory, and this group of drops is combined by electrostatically accelerating upstream drops of the group and/or decelerating downstream drops of the group to combine into a single drop.

German patent applications DE3416449 and DE350190 present CIJ printing heads comprising drop generators which generate a continuous stream of drops. The stream of drops is generated as a result of periodic pressure disturbances in the vicinity of the nozzles that decompose the emerging inkjets to drops which have the same size and are equally spaced. The majority of drops are collected by gutters and fed back to the reservoirs supplying ink to the drop generators, as common in the CIJ technology.

A Japanese patent application JPS5658874 presents a CIJ printing head comprising nozzles generating continuous streams of drops, which are equally spaced, wherein some of the drops are collected by gutters and only some of the drops reach the surface to be printed. The paths of drops are altered by a set of electrodes such that the path of one drop is altered to cross the path of another drop.

Due to substantial structural and technological differences between the CIJ and DOD technology print heads, these print heads are not compatible with each other and individual features are not transferrable between the technologies.

A U.S. Pat. No. 8,342,669 discloses an ink set comprising at least two inks, which can be mixed at any time (as listed: before jetting, during jetting, or after jetting). A particular embodiment specifies that the inks may be mixed or combined anywhere between exiting the ink jet head and the substrate, that is, anywhere in flight. After combination of the inks between the ink jetting device and the substrate, the drops of the inks may begin to react, that is polymerization of the vinyl monomers may begin and momentum of the drops may carry the drops to a desired location on the substrate. This has, however, the disadvantage, that it is difficult to control the parameters of coalescence of the drops, as it the surrounding outside the ink jetting device is variable.

A US patent application US2011/0181674 discloses an inkjet print head including a pressure chamber storing a first ink drawn in from a reservoir and transferring the first ink to a nozzle by a driving force of an actuator; and a damper disposed between the pressure chamber and the nozzle and allowing the first ink to be mixed with a second ink drawn through an ink flow path for the second ink. The disadvantage of that solution is that the mixed ink is in contact with the nozzle. This can lead to problems when the physicochemical parameters of the mixed ink do not allow for jetting of the mixed ink, or the mixed ink is not chemically stable and reactions occurring within the mixed ink cause the change of physicochemical parameters that do not allow for jetting of the mixed ink, or the reaction causes solidification of the mixed ink. In case the chemical reaction is initiated while mixing the ink components, any residue of the mixed ink which gets in contact with the nozzle and is not removed out of it by the stream of gas may cause the residue build up leading to blocking the nozzle during printing process.

SUMMARY

The problem associated with DOD inkjet printing is the relatively long time of curing of the ink after its deposition on the surface remains actual.

There is still a need to improve the DOD inkjet printing technology in order to shorten the time of curing of the ink after its deposition on the surface. In addition, it would be advantageous to obtain such result combined with higher drop energy and more precise drop placement in order to code different products of different substrates and shapes.

There is a need to improve the inkjet print technologies in attempt to decrease the drying (or curing) time of the imprint and to increase the energy of the printing drop being discharged from the printer. The present invention combines those two advantages and brings them to the level available so far only to CIJ printers and unavailable in the area of DOD technology in general (mainly when it comes to drying time) and high resolution DOD technology in particular, where both drying (curing) time and drop energy have been have been very much improved compared to the present state of technology. The present invention addresses also the main disadvantages of CIJ technology leading to min. 10 times reduction of solvent usage and allowing much smaller—compared to those of CIJ—drops to be discharged with higher velocity, while the resulting imprint could be consolidated on the wide variety of substrates still in a very short time and with very high adhesion.

There is presented herein a drop-on-demand printing method comprising performing the following steps in a printing head: discharging a first primary drop of a first liquid to move along a first path; discharging a second primary drop of a second liquid to move along a second path; controlling the flight of the first primary drop and the second primary drop to combine the first primary drop with the second primary drop into a combined drop at a connection point within a reaction chamber within the printing head so that a chemical reaction is initiated within a controlled environment of the reaction chamber between the first liquid of the first primary drop and the second liquid of the second primary drop; and controlling the flight of the combined drop at least by means of a stream of gas.

The method may further comprise controlling the flight of the combined drop by means of surface of the printing head elements.

The method may further comprise controlling the flight of the first primary drop and the second primary drop at least by means of a stream of gas.

The method may further comprise controlling the flight of the first primary drop and the second primary drop by means of surface of the printing head elements.

The method may further comprise controlling the flight of the first primary drop and the second primary drop by a separator that guides the first primary drop and the second primary drop.

The method may further comprise controlling the flight of the first primary drop and the second primary drop by electric field.

The method may further comprise controlling at least one of the following parameters within the reaction chamber: chamber temperature, gas velocity, gas temperature, gas components, electric field, ultrasound field, UV light.

The stream of gas controlling the flight of the combined drop can be intermittent and generated for at least the time of flight of the combined drop through the printing head from the connection point in the reaction chamber to the outlet of the printing head.

The stream of gas controlling the flight of the combined drop can be generated in a continuous manner.

The streams of gas may have a temperature higher than the ambient temperature.

The method may further comprise heating the interior of the printing head to a temperature higher than the ambient temperature.

The method may further comprise heating the primary drops to a temperature higher than the temperature of the surface to be printed.

The streams of gas may have a temperature higher than the temperature of the generated first primary drop and the second primary drop.

The streams of gas can be continued to be generated for a certain duration after the combined drop is generated.

The first liquid is can be an ink base and the second liquid can be a catalyst for curing the ink base.

There is also presented a drop-on-demand printing head comprising a nozzle assembly comprising: a first nozzle connected through a first channel with a first liquid reservoir with a first liquid and having a first drop generating and propelling device for forming on demand a first primary drop of the first liquid and discharging the first primary drop to move along a first path; and a second nozzle connected through a second channel with a second liquid reservoir with a second liquid and having a second drop generating and propelling device for forming on demand a second primary drop of the second liquid and discharging the second primary drop to move along a second path. The printing head further comprises a reaction chamber. The first path crosses with the second path within the reaction chamber at a connection point. The printing head further comprises means for controlling the flight of the first primary drop and the second primary drop and configured to allow the first primary drop to combine with the second primary drop at the connection point into a combined drop so that a chemical reaction is initiated within a controlled environment of the reaction chamber between the first liquid of the first primary drop and the second liquid of the second primary drop; and at least one gas-supplying nozzle configured to supply gas for controlling the flight of the combined drop.

There is also disclosed an inkjet printing head comprising a nozzle assembly having: at least two nozzles, each nozzle being connected through a channel with a separate liquid reservoir for forming a primary drop of liquid at the nozzle outlet; a separator having a downstream-narrowing cross-section positioned between the nozzle outlets for restricting freedom of movement of the primary drops within the printing head from the nozzle outlet in a direction towards a connection point to be combined into a combined drop at the connection point; wherein the freedom of movement of the primary drops is restricted along the length of each side wall of the separator that is not smaller than the diameter of the primary drop exiting the nozzle outlet at that side wall; wherein the nozzle outlets are configured to discharge primary drops at an angle inclined towards the longitudinal axis of the head; and a cover enclosing the nozzle outlets and the connection point.

There is also disclosed an inkjet printing head comprising a nozzle assembly comprising: a pair of nozzles, each nozzle being connected through a channel with a separate liquid reservoir for discharging in a downstream direction a primary drop of liquid at the nozzle outlet to combine at a connection point into a combined drop: a primary enclosure surrounding the nozzle outlets, and having a cross-section narrowing in the downstream direction; a source of a gas stream configured to flow in the downstream direction inside the primary enclosure; and wherein the connection point is located within the primary enclosure.

In one or more embodiments, the printing head may have at least one of the features as described below.

The printing head may further comprise elements configured to control the flight of the combined drop along the surface of these elements.

The printing head may further comprise at least one gas-supplying nozzle configured to supply gas for controlling the flight of the first primary drop and the second primary drop.

The printing head may further comprise elements configured to control the flight of the first primary drop and the second primary drop along the surface of these elements.

The means for controlling the flight of the first primary drop and the second primary drop may be formed by a separator having a downstream-narrowing cross-section positioned between the nozzle outlets.

The separator can be configured to guide the primary drops along its side walls.

The separator can be configured to bounce the primary drops towards the connection point.

The separator may have its side walls adjacent to the nozzle outlets and may e configured to guide the primary drops along its side walls to combine into a combined drop at the separator tip which forms the means for restricting the freedom of combination of the primary drops.

The length of each side wall of the separator can be larger than the diameter of a primary drop exiting the nozzle outlet adjacent to that side wall.

The means for controlling the flight of the first primary drop and the second primary drop may have a form of a primary enclosure surrounding the nozzle outlets and having a cross-section narrowing in the downstream direction; and a source of a gas stream to flow downstream inside primary enclosure.

The primary enclosure may have a first section at its downstream outlet with a diameter larger than the diameter of the combined drop.

The primary enclosure may have a first section at its downstream outlet with a diameter not larger than the diameter of the combined drop.

The length of the first section of the primary enclosure can be not smaller than the diameter of the combined drop.

The printing head may further comprise a secondary enclosure surrounding the primary enclosure and connected to the source of a gas stream and comprising a first section extending downstream from the outlet of the first section of the primary enclosure and having a diameter decreasing downstream to a diameter larger than the diameter of the combined drop.

The primary enclosure may further comprise a third section extending upstream in parallel to the external walls of the nozzles.

The printing head may further comprise means for restricting the freedom of combination of the primary drops into the combined drop.

The means for restricting the freedom of combination of the primary drops into the combined drop at the connection point may have a form of a tube of a downstream-narrowing cross-section.

The tube can be located at the connection point.

The tube can be distanced downstream from the connection point.

The first liquid can be an ink base and the second liquid can be a catalyst for curing the ink base.

The printing head may further comprise charging electrodes at the outlet of the primary enclosure and/or at the outlet of the secondary enclosure and/or deflecting electrodes downstream behind the outlet of the secondary enclosure.

The nozzles can be inclined with respect to the longitudinal axis of the head at an angle from 5 to 75 degrees, preferably from 15 to 45 degrees.

Both nozzles can be inclined with respect to the longitudinal axis of the head at the same angle.

The nozzles can be inclined with respect to the longitudinal axis of the head at different angles.

The nozzles can be configured for discharging the primary drops of liquid in parallel to the longitudinal axis of the head.

The nozzle outlets can be heated.

The printing head may comprise a plurality of nozzle assembles arranged in parallel.

The separator can be further configured to change the path of movement of the primary drops within the printing head from the nozzle outlet in a direction towards a connection point.

The separator can be configured to guide the primary drops along its side walls.

The printing head may further comprise means for restricting the freedom of combination of the primary drops into a combined drop at the connection point.

The separator can be configured to guide the primary drops within the printing head from the nozzle outlet to the connection point and to restrict the freedom of combination of the primary drops into a combined drop at the connection point.

The means for restricting the freedom of combination of the primary drops into a combined drop at the connection point may have a form of a tube of a downstream-narrowing cross-section.

The separator may have a truncated tip. The side walls of the separator can be inclined with respect to the longitudinal axis of the head at an angle from 5 to 75 degrees, and more preferably from 15 to 45 degrees, in particular 0 degrees. The side wall of the separator may have a flat, concave or convex shape to guide the primary drops along a predetermined path of flight. In case the side walls of the separator are other than flat, their fragments can be inclined with respect to the longitudinal axis of the head at an angle from 0 to 90 degrees.

Both side walls of the separator can be inclined with respect to the longitudinal axis of the head at the same angle.

The side walls of the separator can be inclined with respect to the longitudinal axis of the head at different angles.

The side walls of the separator can be inclined with respect to the longitudinal axis of the head at an angle not larger than the angle of inclination of the nozzle channels.

The side walls of the separator can be inclined with respect to the longitudinal axis of the head at an angle larger than the angle of inclination of the nozzle channels.

The separator can be heated.

The head may further comprise gas-supplying nozzles for blowing gas towards the separator tip.

The nozzles can be inclined with respect to the longitudinal axis of the head at an angle from 0 to 90 degrees, preferably from 5 to 75 degrees, more preferably from 15 to 45 degrees.

The primary drops can be ejected from the nozzles with respect to the longitudinal axis of the head at an ejection angle from 0 to 90 degrees, preferably from 5 to 75 degrees, more preferably from 15 to 45 degrees, in particular 90 degrees. The primary drops may be ejected at the ejection angle equal to the angle of inclination of nozzles with respect to the longitudinal axis of the head.

The primary drops may be ejected at the ejection angle different to the angle of inclination of nozzles with respect to the longitudinal axis of the head.

In particular, the primary drops may be ejected perpendicularly to the longitudinal axis of the head.

Both nozzles can be inclined with respect to the longitudinal axis of the head at the same angle.

The nozzles can be inclined with respect to the longitudinal axis of the head at different angles.

The flight of the combined drop can be controlled at least by means of a stream of gas.

BRIEF DESCRIPTION OF DRAWINGS

The invention is shown by means of exemplary embodiment on a drawing, in which.

DETAILED DESCRIPTION

Figure 1:
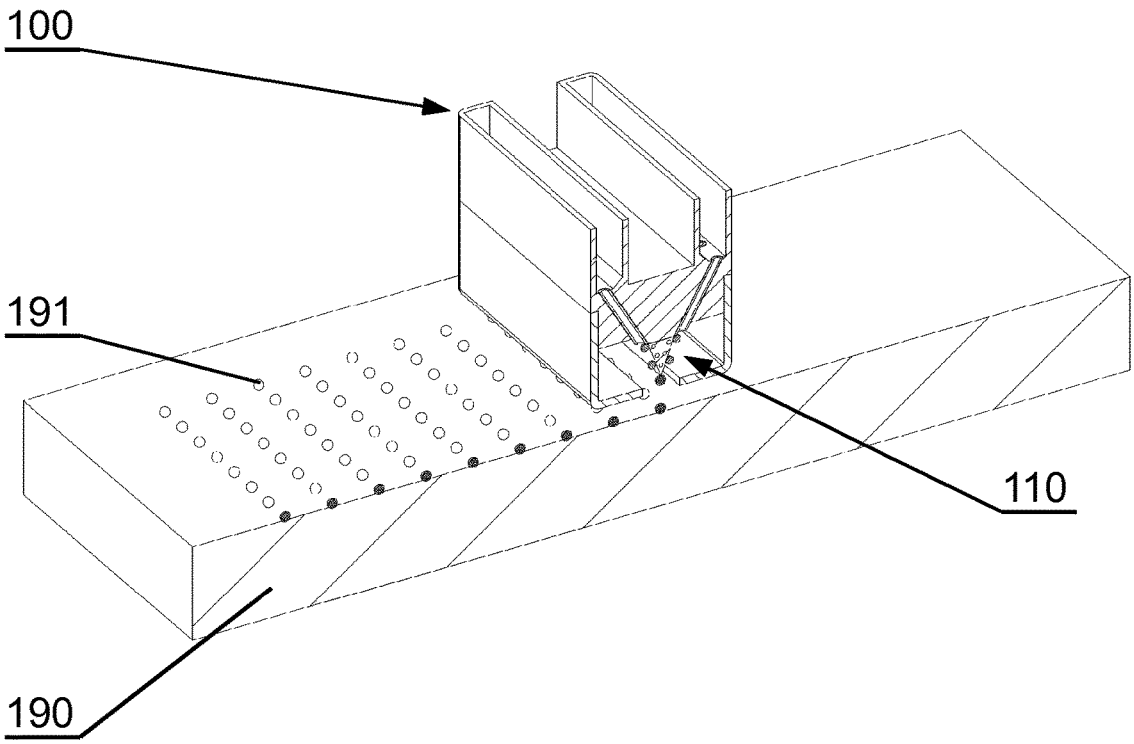
FIG. 1 shows schematically the overview of the first embodiment of the invention.

The details and features of the present invention, its nature and various advantages will become more apparent from the following detailed description of the preferred embodiments of a drop on demand printing head and printing method.

The present invention allows to shorten the time of curing of the ink after its deposition on the surface, by allowing to use fast-curing components which come into chemical reaction in a reaction chamber within the printing head, thereby increasing the efficiency and controllability of the printing process. In other words, the invention provides coalescence in controlled environment.

In the printing head according to the invention, the reaction chamber is configured such that the primary drops can combine therein into a combined drop wherein a chemical reaction is initiated, without the risk of clogging of the reaction chamber or the outlet of reaction chamber. This is achieved by means such as a separator, streams of gas or electric field that guide the primary drops away from the outlets of the nozzles before the primary drops combine with each other (e.g. to a distance of at least 50% of the diameter of the primary drop), such that the primary drops combine in flight (in the controlled and predictable environment of the reaction chamber) and immediately exit the reaction chamber.

The reaction chamber preferably has at the connection point, wherein the combined drop is formed, a size not smaller than the size of the expected size of the combined drop, such as to allow good coalescence of the primary drops.

A chemical reaction is initiated between the component(s) of the first liquid forming the first primary drop and the component(s) of the second liquid forming the second primary drop when the primary drops coalesce to form the combined drop. A variety of substances may be used as components of primary drops. The following examples are to be treated as exemplary only and do not limit the scope of the invention:

- a combined drop of polyacrylate may be formed by chemical reaction between the primary drop of a monomer (for example: methyl methacrylate, ethyl methacrylate, propyl methacrylate, butyl methacrylate optionally with addition of colorant) and the second primary drop of an initiator (for example: catalyst such as trimethylolpropane, tris(1-aziridinepropionate) or azaridine, moreover UV light may be used as initiator agent)
- a combined drop of polyurethane may be formed by chemical reaction between the primary drop of a monomer (for example: 4,4'-methylenediphenyl diisocyanate (MDI) or different monomeric diisocyianates either aliphatic or cycloaliphatic) and the second primary drop of an initiator (for example: monohydric alcohol, dihydric alcohol or polyhydric alcohol such as glycerol or glycol; thiols, optionally with addition of colorant)
- a combined drop of polycarboimide may be formed by reaction between the primary drop of a monomer (for example: carbimides) and the second primary drop of an initiator (for example dicarboxylic acids such as adipic acid, optionally with addition of colorant)

In general, the first liquid may comprise a first polymer-forming system (preferably, one or more compounds such as a monomer, an oligomer (a resin), a polymer etc., or a mixture thereof) and the second liquid may comprise a second polymer-forming system (preferably, one or more compounds such as a monomer, an oligomer (a resin), a polymer, an initiator of a polymerization reaction, one or more crosslinkers etc., or a mixture thereof). The chemical reaction is preferably a polyreaction or copolyreaction, which may involve crosslinking, such as polycondensation, polyaddition, radical polymerization, ionic polymerization or coordination polymerization. In addition, the first liquid and the second liquid may comprise other substances such as solvents, dispersants etc.

By controlling the environment of the reaction chamber, it is possible to achieve controllable, full coalescence of the primary drops (which occurs only at particular conditions, dependent on the liquids, such as the speed, mass of drops, the surface tension, viscosity, angle of incidence). It is typically not possible to control these parameters at the environment outside the printing head, where the ambient temperature, pressure, humidity, wind speed may vary and have significant impact on the coalescence process (and result in deviation of the paths of flight of the drops, generation of satellite drops (which might clog the interior of the printing head), bouncing off of the primary drops, which may lead to at least loss of quality, if not to full malfunction of the printing process).

By increasing the temperature within the printing head, the surface tension and viscosity of the primary drops can be reduced.

If the coalescence process is under control, the chemical reaction may be initiated evenly within the volume of the combined drop, thereby providing prints of predictable quality. The liquids of the primary drops coalesce due to collision between the drops. Mixing within the drop is effected by mechanical manner and by diffusion of the components. The speed of diffusion depends on the difference of concentration of components in the individual drops and the temperature-dependent diffusion coefficient. As the temperature is increased, the diffusion coefficient increases, and the speed of diffusion of the components within the combined drop increases. Therefore, increase of temperature leads to combined drops of more even composition.

In addition, for some compositions, in particular formed of at least 3 drops, apart from the monomer(s) and initiator(s), an additional primary drop of inhibitor may be introduced, in order to slow down the chemical reaction between the monomer(s) and the initiator(s), to allow better homogenization of the composition prior to polymerization.

If the combined drop is formed such that it has a temperature higher than the temperature of the surface to be printed, the combined drop, when it hits the printed surface, undergoes rapid cooling, and its viscosity increases, therefore the drop is less prone to move away from the position at which it was deposited. This cooling process should increase the density and viscosity of the combined drop while deposited, however not to the final solidification stage, since the final solidification should result from completed chemical reaction rather than temperature change only. Moreover, as the chemical reaction (i.e. polymerization, curing (crosslinking)) is already initiated in the combined drop, the crosslinking of individual layers of printed matter is improved (which is particularly important for 3D printing).

The presented drop-on-demand printing head and method can be employed for various applications, including high-quality printing, even on non-porous substrates or surfaces with limited percolation. Very good adhesion of polymers combined with comparatively high drop energy allows for industrial printing and coding with high speeds on a wide variety of products in the last phase of their production process. The control of the gradual solidification, which includes the preliminary density increase allowing the drop to stay where applied, but at the same time allowing the chemical reaction to get completed before the final solidification, makes this technology suitable for advanced 3D printing. The crosslinking between individual layers would allow to avoid anisotropy kind of phenomena in the final 3D printed material, which would be advantageous compared to the great deal of existing 3D ink jet based technology.

First Embodiment

Figure 2A:
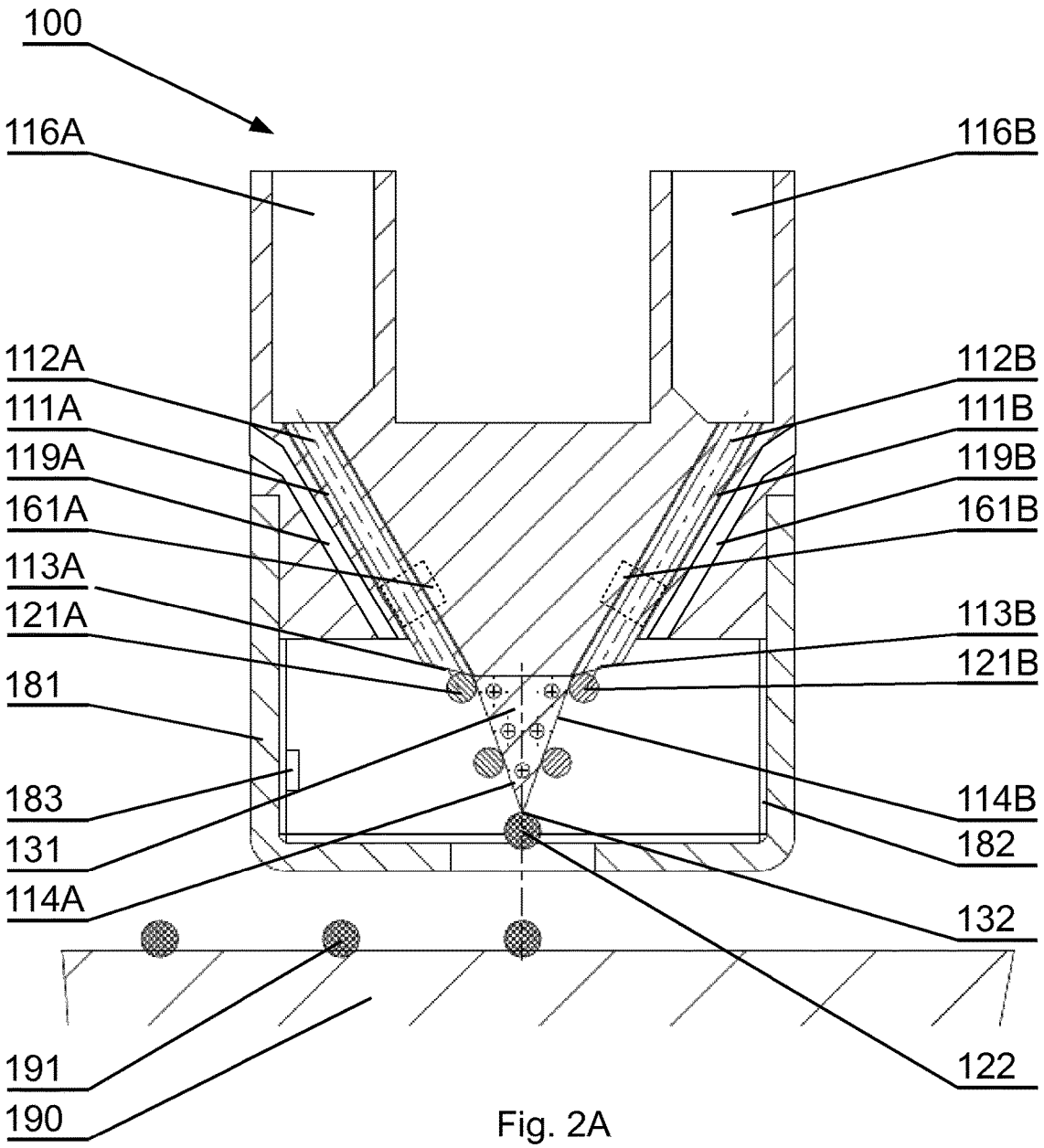
FIGS. 2A and 2B show schematically the first variant of the first embodiment.
Figure 2B:
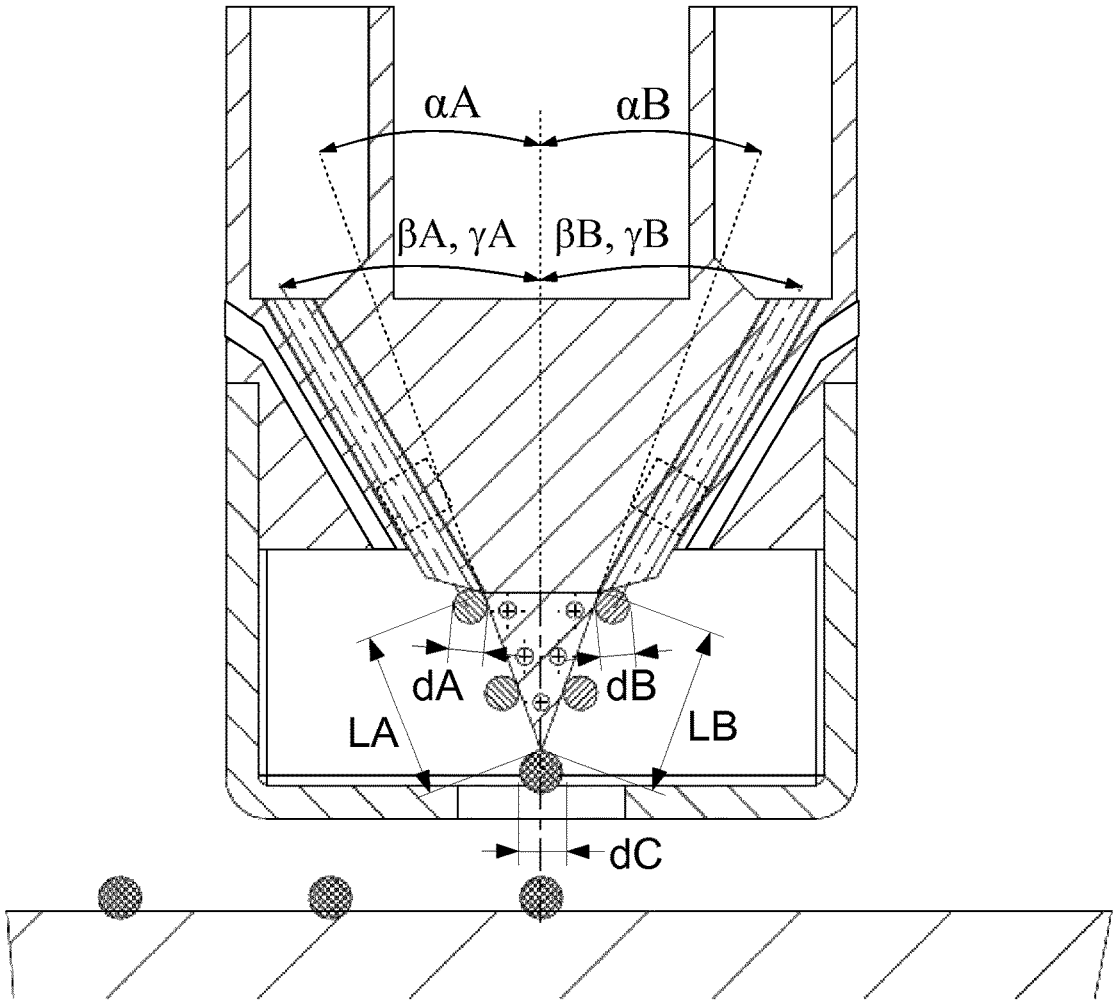

A first embodiment of the inkjet printing head 100 according to the invention is shown in an overview in FIG. 1 and in a detailed cross-sectional views in various variants on FIGS. 2A-2E. FIGS. 2A and 2B show the same cross-sectional view, but for clarity of the drawing different elements have been referenced on different figures.

The inkjet printing head 100 may comprise one or more nozzle assemblies 110, each configured to produce a combined drop 122 formed of two primary drops 121A, 121B ejected from a pair of nozzles 111A, 111B separated by a separator 131. The embodiment can be enhanced by using more than two nozzles. FIG. 1 shows a head with 8 nozzle assemblies 110 arranged in parallel to print 8-dot rows 191 on a substrate 190. It is worth noting that the printing head in alternative embodiments may comprise only a single nozzle assembly 110 or more or less than 8 nozzle assemblies, even as much as 256 nozzle assemblies or more for higher-resolution print.

Each nozzle 111A, 111B of the pair of nozzles in the nozzle assembly 110 has a channel 112A, 112B for conducting liquid from a reservoir 116A, 116B. At the nozzle outlet 113A, 113B the liquid is formed into primary drops 121A, 121B as a result of operation of drop generating and propelling devices 161A, 161B shown in FIGS. 10, 11, 12. The nozzle outlets 113A, 113B are adjacent to a separator 131 having a downstream-narrowing cross-section (preferably in a shape of a longitudinal wedge or a cone) that separates the nozzle outlets 113A, 113B and thus prevents the undesirable contact between primary drops 121A and 121B prior to their full discharge from their respective nozzle outlets 113A and 113B. The primary drops 121A, 121B ejected from the nozzle outlets 113A, 113B move along respectively a first path and a second path along the separator 131 towards its tip 132, where they combine to form a combined drop 122, which separates from the separator tip 132 and travels towards the surface to be printed. Therefore, the separator 131 functions as means for controlling the flight of the first primary drop 121A and the second primary drop 121B to allow the first primary drop 121A to combine with the second primary drop 121B at the connection point 132 into the combined drop 122.

The liquids supplied from the two reservoirs 116A, 116B are a first liquid (preferably an ink) and a second liquid (preferably a catalyst for initiating curing of the ink). This allows initiation of a chemical reaction between the first liquid of the first primary drop 121A and the second liquid of the second primary drop 121B for curing of the ink in the combined drop 122 before it reaches the surface to be printed, so that the ink may adhere more easily to the printed surface and/or cure more quickly at the printed surface.

The chemical reaction is initiated at the connection point 132 (at which the first path crosses with the second path) within a reaction chamber, which is in this embodiment formed by the cover 181 of the print head.

For example, the ink may comprise acrylic acid ester (from 50 to 80 parts by weight), acrylic acid (from 5 to 15 parts by weight), pigment (from 3 to 40 parts by weight), surfactant (from 0 to 5 parts by weight), glycerin (from 0 to 5 parts by weight), viscosity modifier (from 0 to 5 parts by weight). The catalyst may comprise azaridine based curing agent (from 30 to 50 parts by weight), pigment (from 3 to 40 parts by weight), surfactant (from 0 to 5 parts by weight), glycerin (from 0 to 5 parts by weight), viscosity modifier (from 0 to 5 parts by weight), solvent (from 0 to 30 parts by weight). The liquids may have a viscosity from 1 to 30 mPas and surface tension from 20-50 mN/m. Other inks and catalysts known from the prior art can be used as well. Preferably, the solvent amounts to a maximum of 10%, preferably a maximum of 5% by weight of the combined drop. This allows to significantly decrease the content of the solvent in the printing process, which makes the technology according to the invention more environmentally-friendly than the current CIJ technologies, where the content of solvents usually exceeds 50% of the total mass of the drop during printing process. For this reason, the present invention is considered to be a green technology.

In the first variant of the first embodiment, as shown in FIGS. 2A and 2B, the ink drop is combined with the catalyst drop within the reaction chamber 181, i.e. when the drops are in contact with the components of the head 100, in particular at the separator tip 132. However, the head construction is such that the nozzle outlets 113A, 113B are separated from each other by the separator 131 and therefore the ink and the catalyst will not mix directly at the nozzle outlets 113A, 113B, which prevents the nozzle outlets 113A, 113B from clogging. Once the drops are combined to a combined drop 122, there risk of clogging of the separator tip 132 is minimized, as the separator tip 132 has a small surface and the kinetic energy of the moving combined drop 122 is high enough to detach the combined drop 122 from the separator tip 132. The separator 131 guides the drops 121A, 121B along its surface, therefore the drops 121A, 121B are guided in a controlled and predictable manner until they meet each other. It enables much better control over the coalescence process of two primary drops as well as the control over the direction that the combined drop will follow after its discharge from the separator tip 132. It is therefore easy to control drop placement of the combined drop 122 on the surface to be printed. Even if, due to differences in size or density or kinetic energy of the primary drops 121A, 121B, the combined drop 122 would not exit the head perpendicularly (as shown in FIGS. 2A and 2B) but at an inclined angle, that angle would be relatively constant and predictable for all drops, therefore it could be taken into account during the printing process. Even relatively large-size drops—like those used for instance in low resolution valve based ink jet printers—can be combined due to the use of the separator 131 in a more predictable manner than in the prior art solutions where drops combine in-flight outside the printhead.

Therefore, the separator 131 functions as a guide for the primary drops 121A, 121B within the reaction chamber from the nozzle outlet 113A, 113B to a connection point, i.e. the separator tip 132. The separator tip 132 restricts the freedom of combination of primary drops 121A, 121B into a combined drop 122, i.e. the combined drop may form only under the separator tip 132, which impacts its further path of travel—downwards, towards the opening in the cover 181. In other words, in the presented inkjet head, the drops 121A, 121B of at least two components, which before the combination have properties of stable liquids, are guided to a connection point wherein they are still kept in contact with the components of the head, i.e. with the separator 131 down to its tip 132. Therefore, during combination and coalescence of the primary drops 121A, 121B, they are in contact with the head components.

Figure 9:
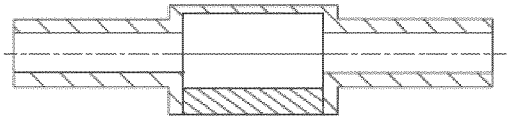
FIGS. 9, 10, 11 show schematically different devices for propelling a drop out of the nozzle.
Figure 10:
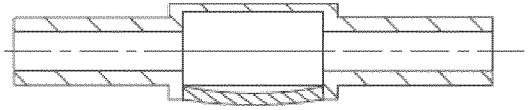
Figure 11:
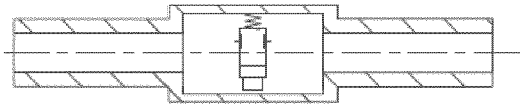

The nozzles 112A, 112B have drop generating and propelling devices 161A, 161B for ejecting the drops, which are only schematically marked in FIGS. 2A and 2B, and their schematically depicted types are shown in FIGS. 10-12. The drop generating and propelling devices may be for instance of thermal (FIG. 9), piezoelectric (FIG. 10) or valve (FIG. 11) type. In case of the valve the liquid would need to be delivered at adequate pressure.

The separator 131 as shown in FIGS. 2A and 2B is symmetrical, i.e. the inclination angles $\alpha$A, $\alpha$B of its side walls 114A, 114B are the same with respect to the axis of the head 100 or of the nozzle arrangement 110. In alternative embodiments, the separator may be asymmetric, i.e. the angles $\alpha$A, $\alpha$B may be different, depending on the parameters of liquids supplied from the nozzle outlets 113A, 113B.

The inclination angles $\alpha$A, $\alpha$B are possible from 0 to up to 90 degrees, preferably from 5 to 75 degrees, and more preferably from 15 to 45 degrees.

Preferably, the inclination angles $\beta$A, $\beta$B of the nozzle channels 112A, 112B (which are in this embodiment equal to the ejection angles $\gamma$A, $\gamma$B at which the primary drops are ejected from the nozzle channels) are not smaller (as shown in FIG. 2B) than the inclination angles $\alpha$A, $\alpha$B of the corresponding separator walls 114A, 114B, so that the ejected primary drops 121A, 121B are forced into contact with the separator walls 114A, 114B.

The separator 131 can be replaceable, which allows to assembly the head 110 with a separator 131 having parameters corresponding to the type of liquid used for printing.

The separator 131 preferably has a length LA, LB of its side wall 114A, 114B, respectively, measured from the nozzle outlet 113A, 113B to the separator tip 132, not shorter than the diameter dA, dB of the primary drop 121A, 121B exiting the nozzle outlet 113A, 113B at that side wall 114A, 114B. This prevents the primary drops 121A, 121B from merging before they exit the nozzle outlets 113A, 113B.

The surface of the separator 131 has preferably a low friction coefficient to provide low adhesion of the drops 121A, 121B, 122, such as not to limit their movement and not introduce spin rotation of the primary drops 121A, 121B. Moreover, the side walls of the separator 131 are inclined such as to have a high wetting angle between the side walls and the primary drops, such as to decrease adhesion. In order to decrease adhesion between the separator and the drops 121A, 121B, 122, the separator and/or the nozzle outlets 113A, 113B may be heated to a temperature higher than the temperature of the environment. The liquids in the reservoirs 116A, 116B may be also preheated. Increased temperature of working fluids (i.e. ink and catalyst) may also lead to improved coalescence process of primary drops and preferably increase adhesion and decrease the curing time of the combined drop 122 when applied on the substrate.

As shown in FIG. 1, the separator 131 may be common for a plurality of nozzle assemblies 110. In alternative embodiments, each nozzle assembly 110 may have its own separator 131 and/or cover 181 or a sub-group of nozzle assemblies 110 may have its own common separator 131 and/or cover 181.

The printing head may further comprise a cover 181 which protects the head components, in particular the separator tip 132 and the nozzle outlets 113A, 113B, from the environment, for example prevents them from touching by the user or the printed substrate.

Moreover, the cover 181 may comprise heating elements 182 for heating the volume within the reaction chamber 181, i.e. the volume surrounding of the nozzle outlets 113A, 113B and the separator 131 to a predetermined temperature, for example from 40° C. to 60° C. (other temperatures are possible as well, depending on the parameters of the drops), such as to provide stable conditions for combining of the drops. A temperature sensor 183 may be positioned within the cover 181 to sense the temperature.

Moreover, the printing head 110 comprises gas-supplying nozzles 119A, 119B for blowing gas (such as air or nitrogen), preferably heated to a temperature higher than the ambient temperature or higher than the temperature of the liquids in the first and second reservoir (i.e. to a temperature higher than the temperature of the generated first and second drop), towards the separator tip 132, in order to decrease the curing time, increase the dynamics of movement of the drops and to blow away any residuals that could be formed at the nozzles outlets 113A, 113B separator tip 132. In this embodiment, as well as in the other embodiments described below, the streams of gas can be generated in an intermittent manner, for at least the time of flight of the combined drop through the printing head from the connection point in the reaction chamber to the outlet of the printing head, which allows to control by means of the streams of gas the flight of the combined drop. Moreover, the streams of gas can be generated in an intermittent manner, for at least the time since the primary drops exit the nozzle outlets till the combined drop exits the outlet of the printing head, which allows to control by means of the streams of gas the flight of the primary drops and of the combined drop. Moreover, the streams of gas may continue to blow after the combined drop exits the printing head, for example even for a few seconds after the printing is finished (i.e. after the last drop is generated), in order to clean the components of the printing head from any residue of the first liquid, second liquid or their combination. The stream of gas may be also generated and delivered in a continuous manner.

Therefore, that embodiment can be used in drop on demand printing method to discharge the first primary drop 121A of the first liquid to move along the first path and to discharge the second primary drop 121B of the second liquid to move along the second path; and to control, by means of the separator, the flight of the first primary drop 121A and the second primary drop 121B to combine the first primary drop 121A with the second primary drop 121B at the connection point 132 within the reaction chamber 181 within the printing head so that a chemical reaction is initiated within a controlled environment of the reaction chamber 181 between the first liquid of the first primary drop 121A and the second liquid of the second primary drop 121B. The path of flight of the primary drops 121A, 121B and of the combined drop 122 is further controlled by means of the streams of gas supplied from the gas-supplying nozzles 119A, 119B.

Figure 2C:
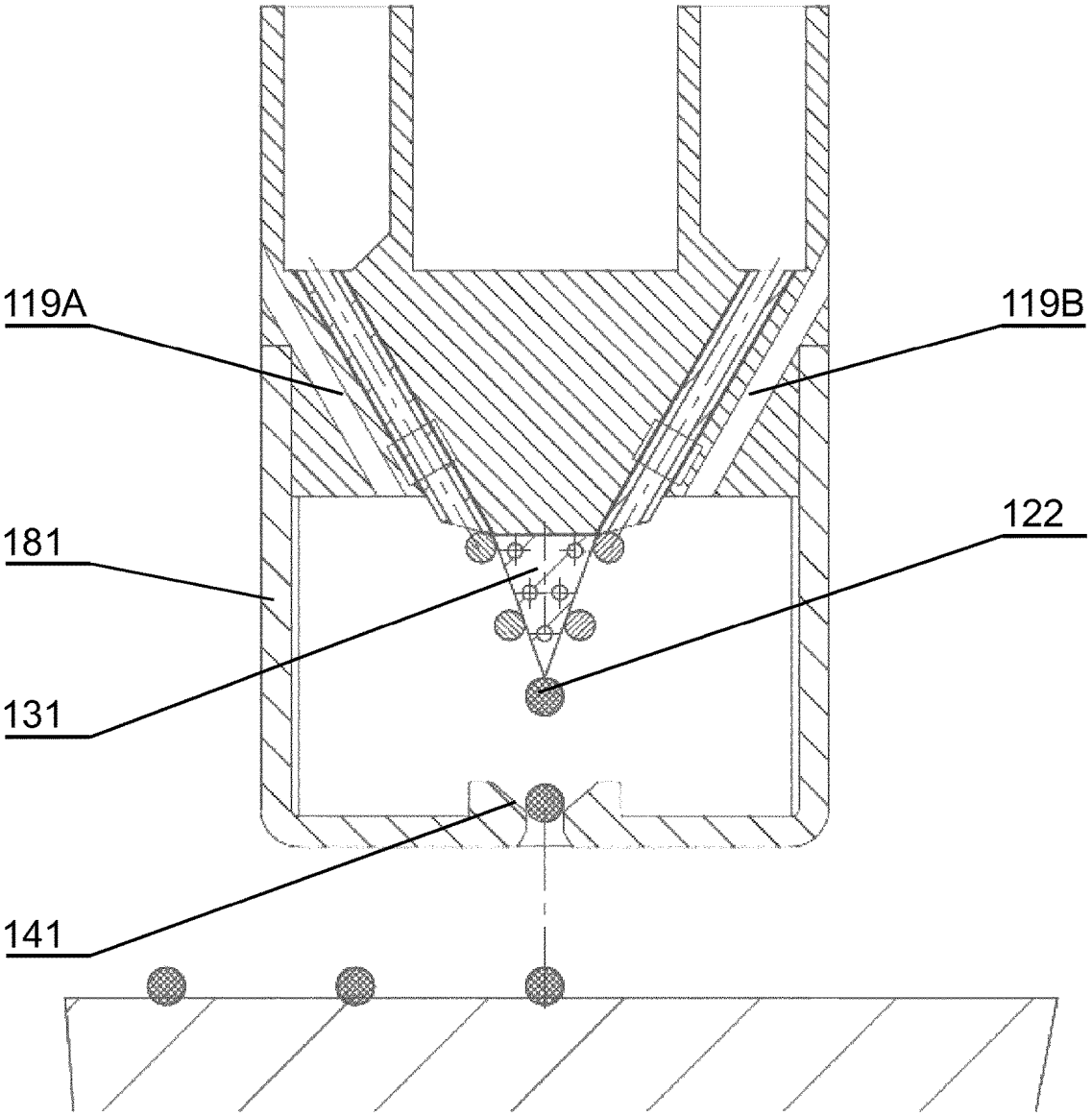
FIG. 2C shows schematically the second variant of the first embodiment.

The second variant of the first embodiment, as shown in FIG. 2C, differs from the first variant of FIG. 2A in that a tube 141 of a narrowing cross-section is formed at the outlet opening of the cover 181, i.e. at the outlet of the reaction chamber. The downstream outlet of the tube 141 has preferably a cross-section of a diameter substantially equal to the desired diameter of the combined drop 122, or alternatively it is not smaller than at least 80% of the cross-section of the combined drop 122. Therefore, at the downstream outlet of the tube 141 there is formed a kind of pneumatic combined drop nozzle, through which the drop is pushed thanks to its kinetic energy. This improves precision of its movement directly forward, which facilitates precise drop placement, which in turn improves the print quality. The tube 141 is located at some distance from the connection point, which in this variant is at the tip of the separator 131.

Figure 2D:
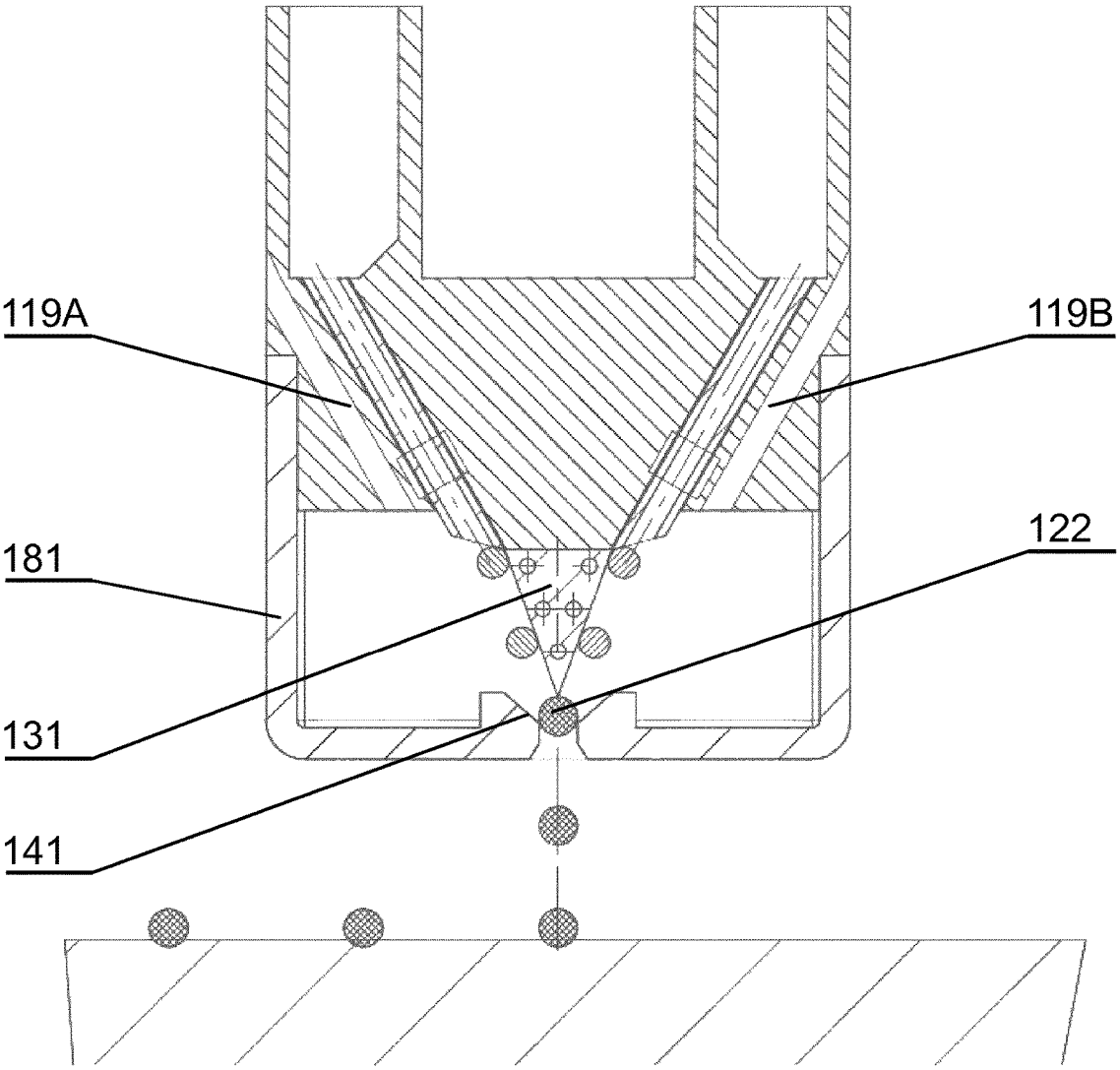
FIG. 2D shows schematically the third variant of the first embodiment.

The third variant of the first embodiment, as shown in FIG. 2D, differs from the second variant of FIG. 2C in that the tube 141 is located at the connection point, such that it's both the tube 141 and the tip of the separator 131 that jointly function as means for restricting the freedom of combination of the primary drops into a combined drop at the connection point. Therefore, the tube 141 functions both as the restricting means and a combined drop nozzle. In other words, the connection point 132 is located at the outlet of the reaction chamber.

Figure 2E:
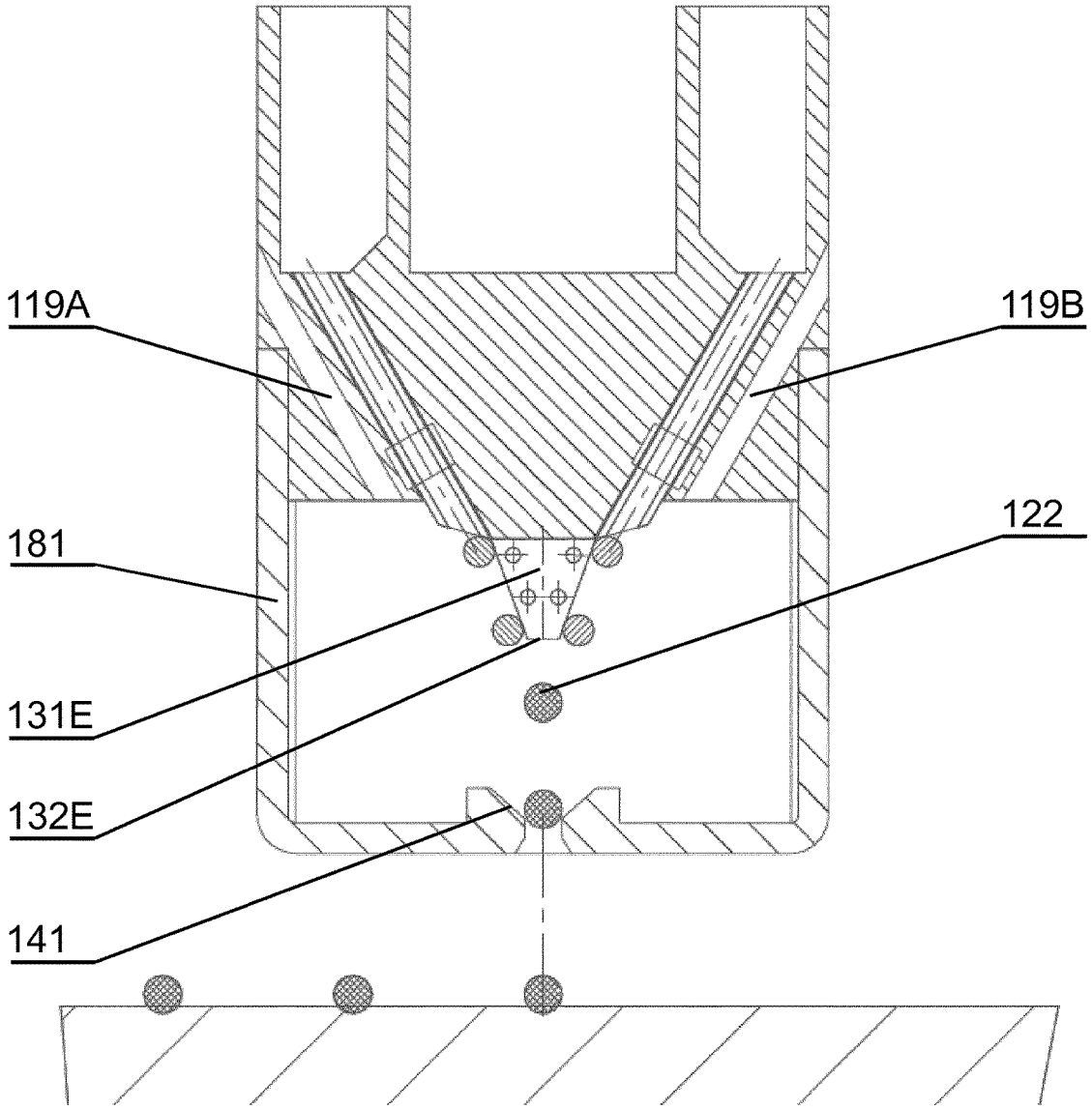
FIG. 2E shows schematically the fourth variant of the first embodiment.

The fourth variant of the first embodiment, as shown in FIG. 2E, differs from the second variant of FIG. 2C in that the separator 131E has a truncated tip 132E, such that the primary drops are only guided from the nozzle outlets towards the connection point, but are no longer in contact with the separator 131E at the connection point. In that case, the coalescence process occurs unrestricted at the connection point, but is at least partially controlled in that the primary drops have been guided by the separator side walls, so that their direction is more precisely set as compared to drops which would have been discharged directly from the nozzle outlets and not guided on their way towards the connection point. In order to correct any irregularities that may have appeared at the combined drop 122 due to its free coalescence, the tube 141 is used to catch the combined drop 122 and to form it to a desired diameter and align it with a desired axis of flow. The tube 141 is herein distanced downstream from the connection point.

Second Embodiment

Figure 3:
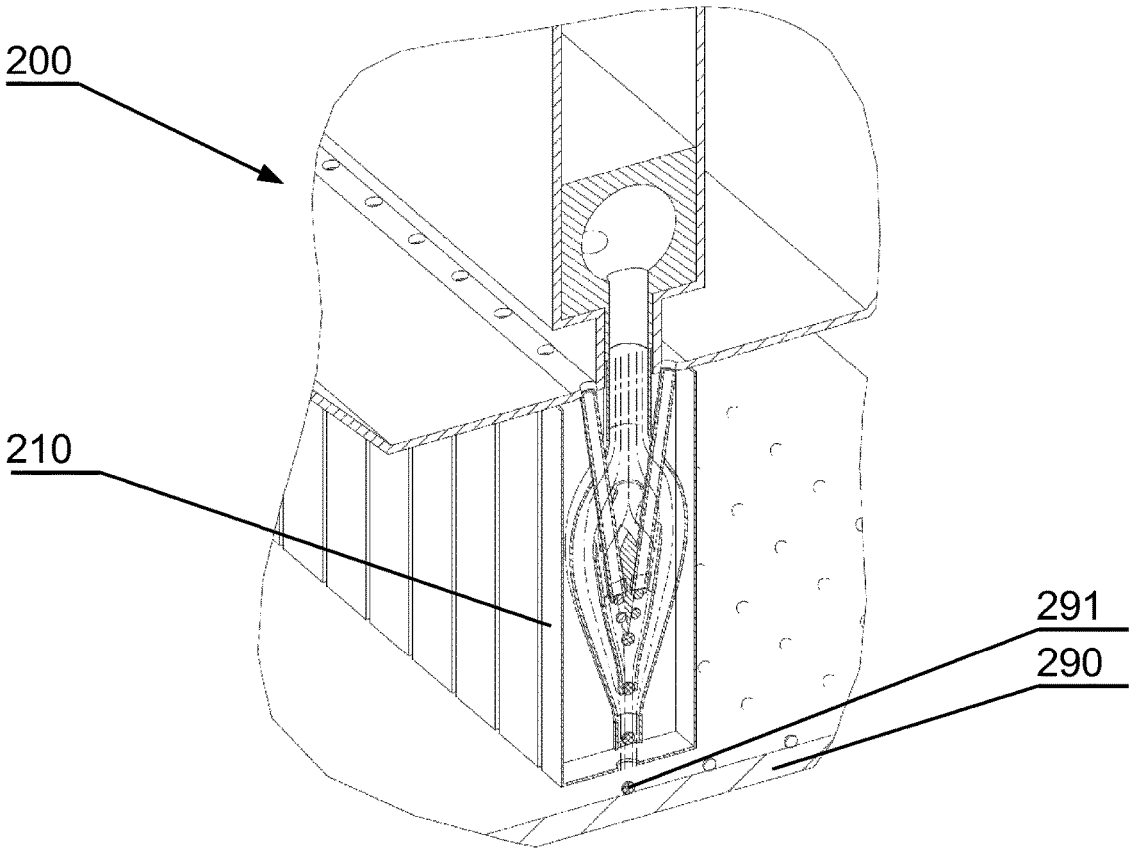
FIGS. 3, 4A, 4B, 5 and 6 show schematically the first variant of the second embodiment of the invention.
Figure 4A:
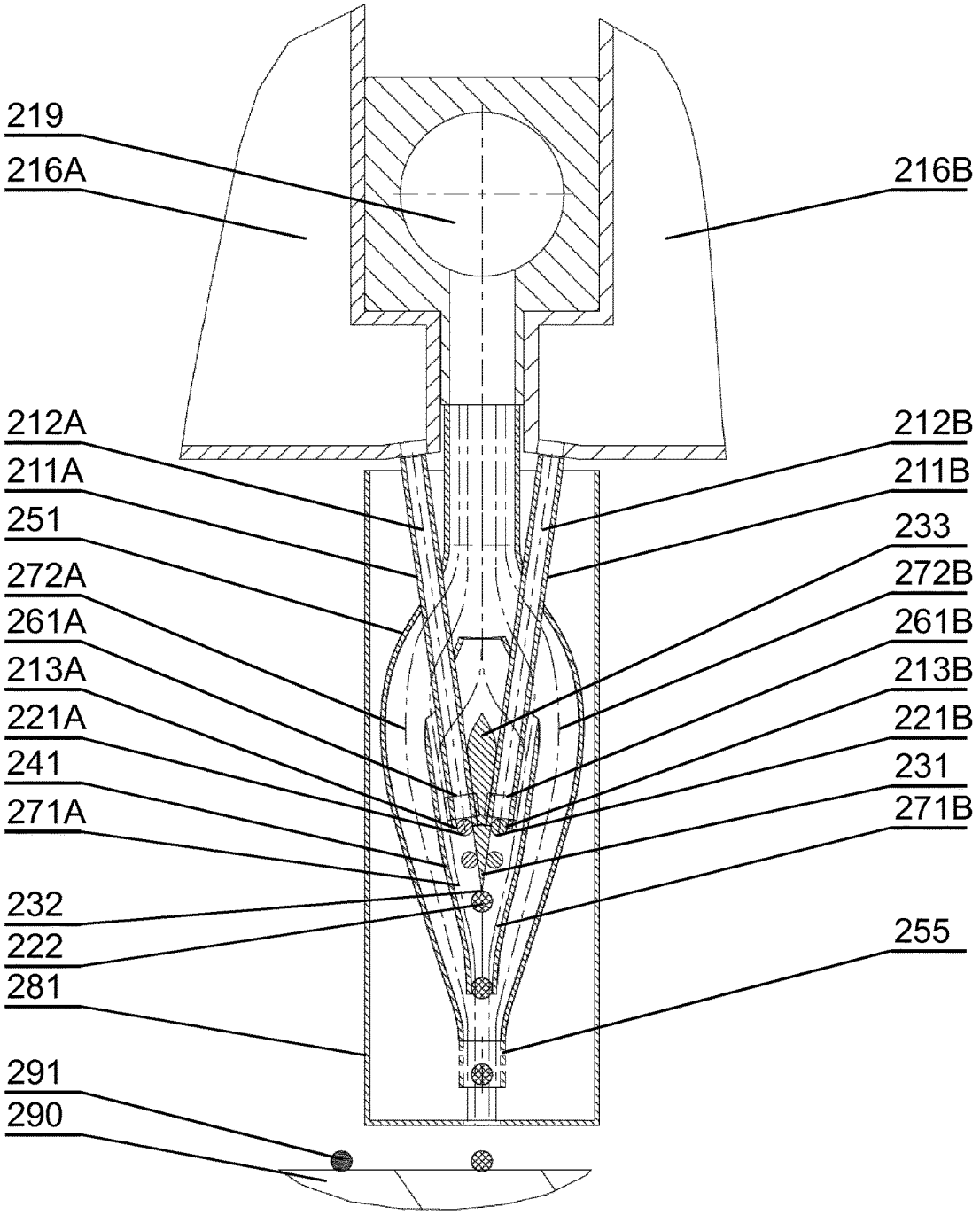
Figure 4B:
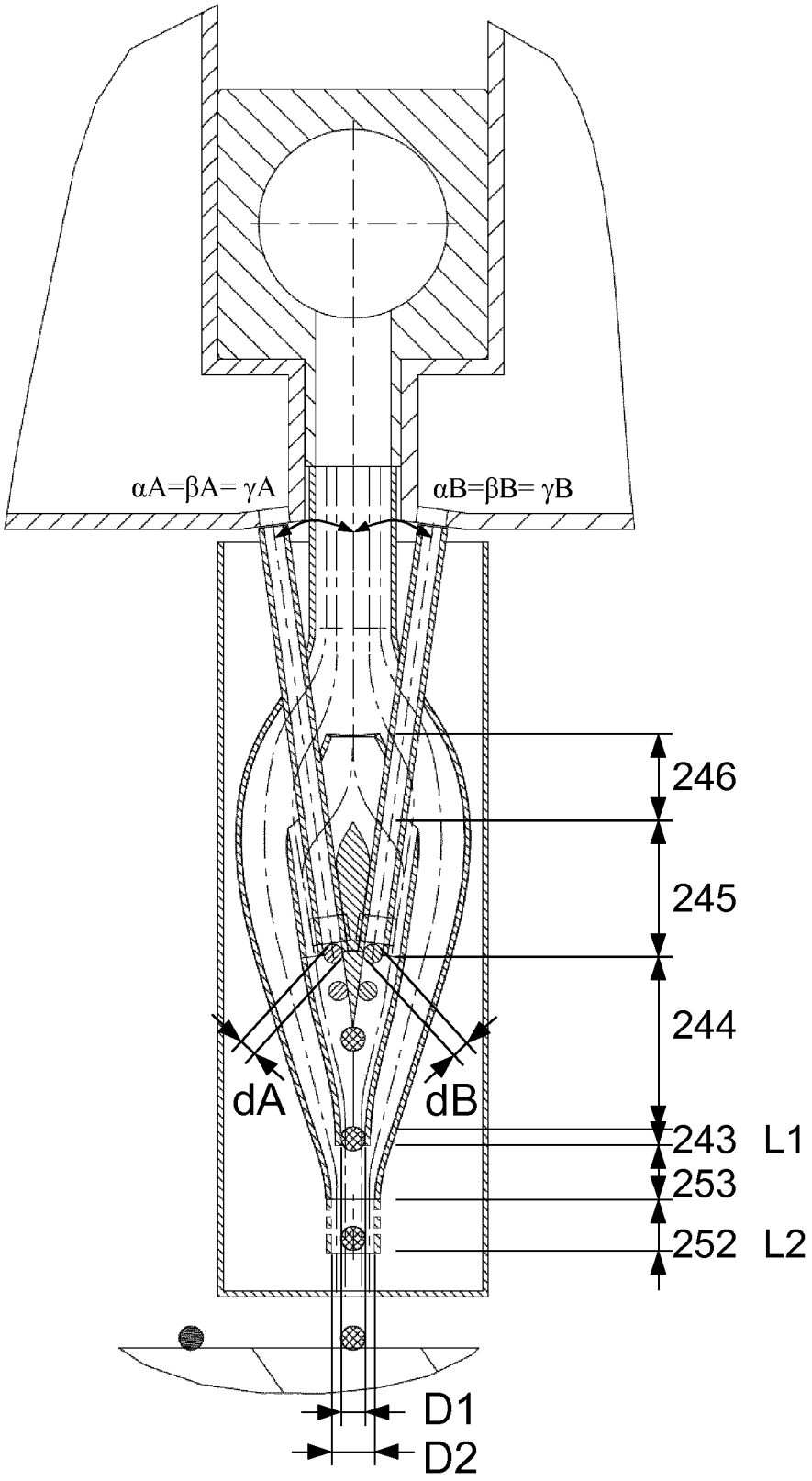
Figure 5:
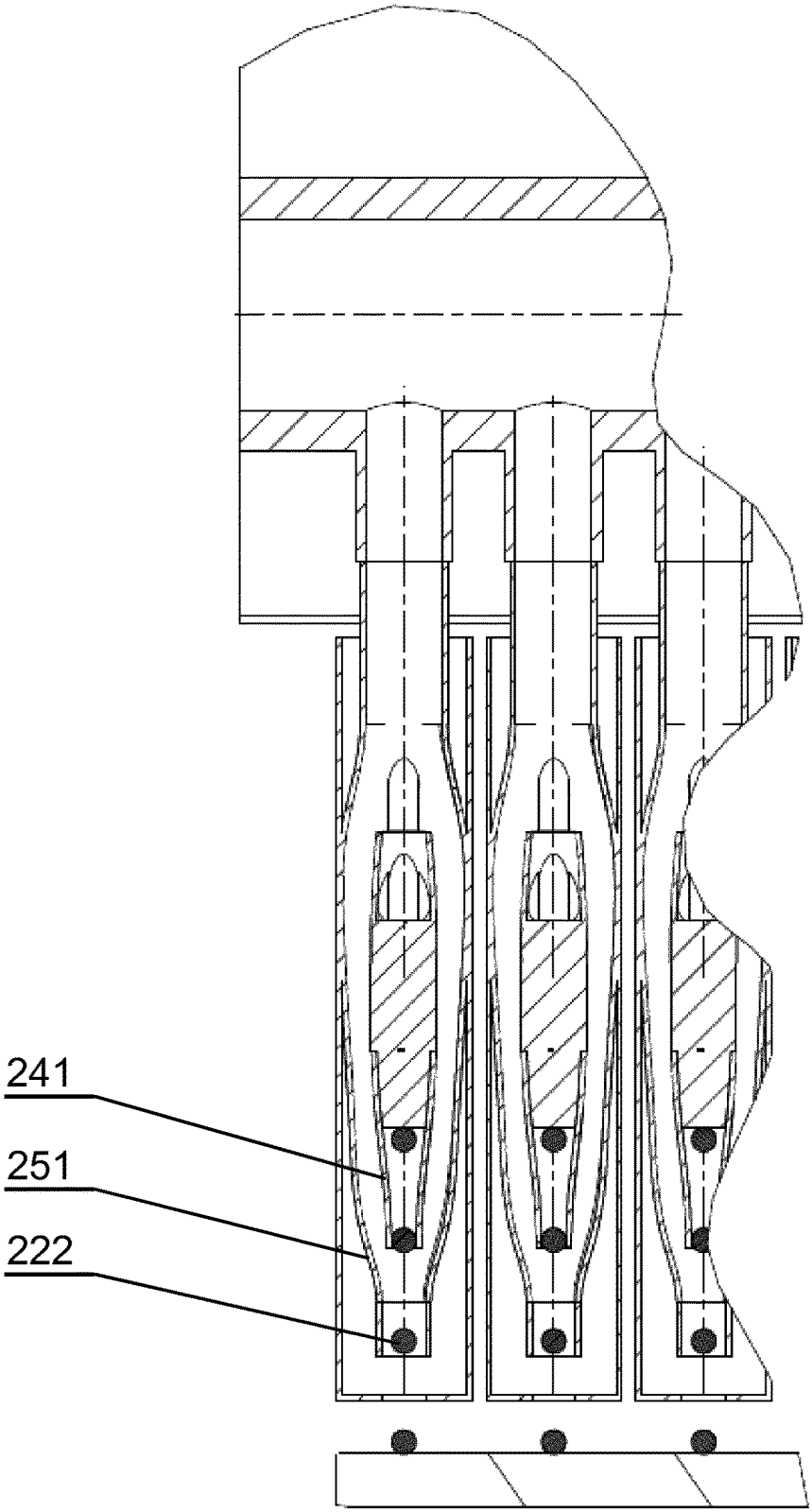
Figure 6:
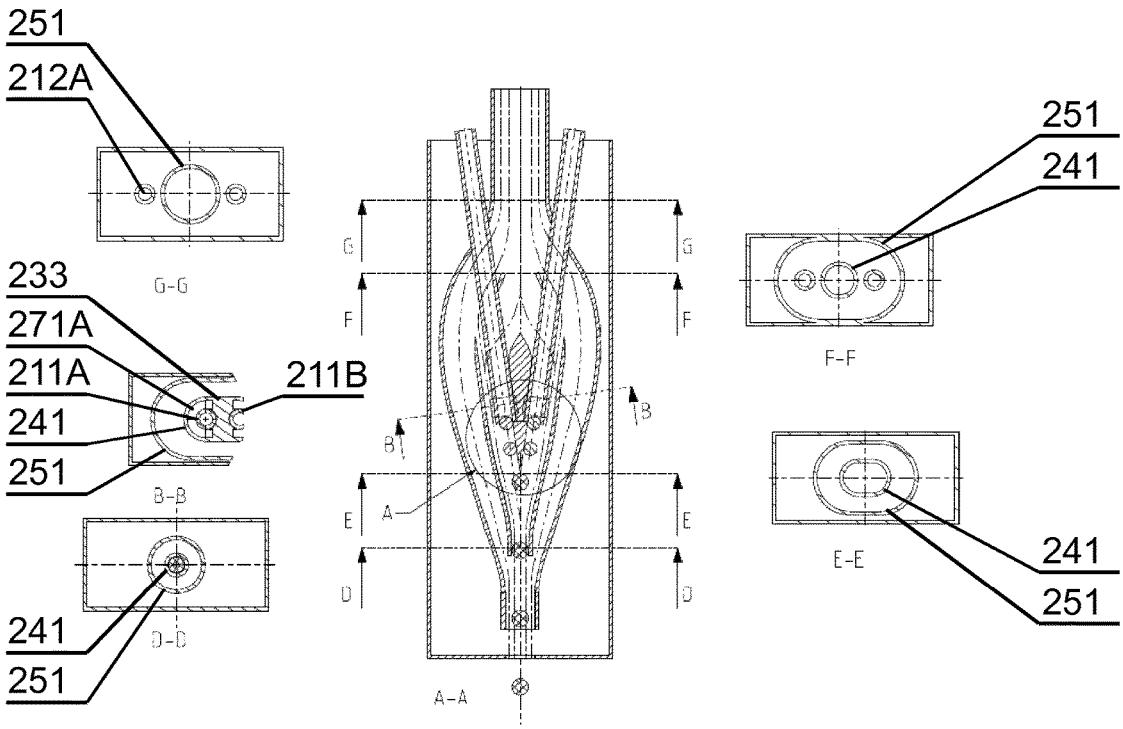

A first variant of the second embodiment of the inkjet printing head 200 according to the invention is shown in an overview in FIG. 3. FIGS. 4A and 4B show the same longitudinal cross-sectional view, but for clarity of the drawing different elements have been referenced on different figures. FIG. 5 shows a longitudinal cross-sectional view along a section parallel to that in FIGS. 4A and 4B. FIG. 6 shows various transverse cross-sectional views.

The inkjet printing head 200 may comprise one or more nozzle assemblies 210, each configured to produce a combined drop 222 formed of two primary drops 221A, 221B ejected from a pair of nozzles 211A, 211B. FIG. 3 shows a head with a plurality of nozzle assemblies 210 arranged in parallel to print multi-dot rows 291 on a substrate 290. It is worth noting that the printing head may comprise only a single nozzle assembly 210 or even as much as 256 nozzle assemblies or more.

Each nozzle 211A, 211B of the pair of nozzles in the nozzle assembly 210 has a channel 212A, 212B for conducting liquid from a reservoir 216A, 216B. At the nozzle outlet 213A, 213B the liquid forms a primary drop 221A, 221B. At the nozzle outlet 213A, 213B the liquid is formed into primary drops 221A, 221B as a result of operation of drop generating and propelling devices 261A, 261B shown on FIGS. 10, 11, 12. The nozzle outlets 213A, 213B are adjacent to a conical-shaped separator 231 that separates the nozzle outlets 213A, 213B. The primary drops ejected from the nozzle outlets 213A, 213B move along respectively a first path and a second path along the separator 231 towards its tip 232, where they combine to form a combined drop 222, which separates from the separator tip 232 and travels towards the surface to be printed.

The primary drops 221A, 221B are guided along the surface of the separator 231 by streams 271A, 271B of gas (such as air or nitrogen, provided from a pressurized gas input 219 (e.g. a gas supplying nozzle), having a pressure of preferably 5 bar) inside a primary enclosure 241. The shape of the primary enclosure 241 in its upper part helps to direct the stream of gas alongside the nozzles 211A, 211B and guides drops from the outlets 213A, 213B of the nozzles 211A, 211B towards the connection point at the separator tip 232, at which they join to form the combined drop 222. Therefore, for all embodiments, the connection point can be considered as any point on the path of the primary drops, starting from the point at which the coalescence starts, via points at which the coalescence develops, towards a point at which the coalescence ends, i.e. the combined drop is formed to its final shape. It is important that the separator guides the drops towards that connection point. Preferably, at the connection point, the freedom of combination of the primary drops into a combined drop is restricted, so as to aid development of the combined drop.

The nozzles 212A, 212B have drop generating and propelling devices 261A, 261B for ejecting the drops, which are only schematically marked in FIGS. 4A and 4B, and their schematically depicted types are shown in FIGS. 10-12. The drop generating and propelling devices may be for instance of thermal (FIG. 9), piezoelectric (FIG. 10) or valve (FIG. 11) type. In case of the valve the liquid would need to be delivered at adequate pressure.

The primary enclosure 241 has sections of different shapes. The first section 243, which is located furthest downstream (i.e. towards the direction of flow of the combined drop 222) has preferably a constant, round cross-section of a diameter D1 substantially equal to the desired diameter dC of the combined drop 222. Alternatively, the cross-section of the first section 243, is preferably not smaller than at least 80% of the cross-section of the combined drop 222. Therefore, at the outlet of the primary enclosure 241 at the downstream end of the first section 243, there is formed a kind of combined drop nozzle, through which the drop is pushed thanks to its kinetic energy enhanced by moving gas. This improves precision of its movement directly forward, which facilitates precise drop placement, which in turn improves the print quality. The second section 244 (of primary enclosure 241) is located between the first section 243 and the nozzle outlets 213A, 213B and has a diameter which increases upstream (i.e. opposite the direction of drops flow), such that its upstream diameter encompasses the nozzle outlets 213A, 213B and leaves some space for gas 271A, 271B to flow between the enclosure walls and nozzle outlets 213A, 213B. At the same time the cross section of the primary enclosure 241 changes upstream from round to elliptical one, since the width of the cross section increases more with length upstream, than its depth (cf. cross section E-E on FIG. 6). The internal walls of the second section 244 converge downstream, therefore the flowing gas stream 271A, 271B forms an outer gas sleeve that urges the drops 221A, 221B, 222 towards the centre of the enclosure 241.

The primary enclosure 241 may further comprise a third section 245 located upstream the second section, which has internal walls in parallel to the external walls of the nozzles 211A, 211B. As more clearly visible in the cross-section B-B (shown for the left part only) of FIG. 6, the nozzle 211A is surrounded by the primary enclosure 241 and separated from the nozzle 211B by the blocking element 233, such that the stream of gas 271A flows only at the outer periphery of the nozzles 211A, 211B but not between the nozzles 211A, 211B wherein it is blocked by the blocking element 233, which then forms the separator 231.

The stream of gas 271A, 271B that is guided by this section is in parallel to the direction of ejecting of the primary drops 221A, 221B from the nozzle outlets 213A, 213B. Parallel direction of the flowing gas stabilized prior to its contact with primary drops improves the control over the path of drops flow starting from the nozzle outlets 213A, 213B, since from the very moment of discharge, their flow is supported in terms of energy and direction by the flowing gas. It is worth noticing that the shape of the primary enclosure 241 is preferably designed in such a way to enhance the appropriate velocity of gas flowing thorough respective sections, i.e. 245, 244, 243. The velocity of the flowing gas is preferably higher than drop velocity precisely at the nozzle outlets area, which is close to the end of section 245, preferably at least not lower than the drop velocity in the area of the section 244 and higher again in the nozzle 243, where the flow will be forced to be of higher velocity again due to the smaller cross section surface of the outflow channel, i.e. the nozzle 243. Such design would leave some room for gas pressure momentary compensating adjustments while for the short instant the gas flow through the nozzle 243 would slow down by passing combined drop 222. This momentary pressure increase in the section 244 would preferably add more kinetic energy for the drop 222 on leaving the nozzle 243.

In any case in the second section 244 of the primary enclosure 241 the gas stream 271A, 271B is preferably configured to flow with a linear velocity not smaller than the velocity of the primary ink drops 221A, 221B ejected from the nozzle outlets 213A, 213B. The temperature of the gas may be increased to allow better coalescence and mixing of the primary drops 221A, 221B by decreasing the surface tension and viscosity of the ink and the curing agent (polymerization initiator). The geometry of the first section 243 relative to the second section 244—especially the decrease of cross section surface of section 243 vs. section 244—is designed such that the gas increases its velocity, preferably from 5 to 20 times, thus increasing the kinetic energy of the coalesced combined drop 222 and stabilizing the flow of the combined drop 222.

Therefore, the separator 231 and the streams 271A, 271B of gas function as means for controlling the flight of the first primary drop 221A and the second primary drop 221B to allow the first primary drop 221A to combine with the second primary drop 221B at the connection point 232 into the combined drop 222.

The liquids supplied from the two reservoirs 216A, 216B are a first liquid (preferably an ink) and a second liquid (preferably a catalyst for initiating curing of the ink), as described with reference to the first embodiment. This allows initiation of a chemical reaction between the first liquid of the first primary drop 221A and the second liquid of the second primary drop 221B for curing of the ink in the combined drop 222 before it reaches the surface to be printed, so that the ink may adhere more easily to the printed surface and/or cure more quickly at the printed surface.

The chemical reaction is initiated at the connection point 232 (at which the first path crosses with the second path) within a reaction chamber, which is in this embodiment formed by the primary enclosure 241.

In the second embodiment, the ink drop is combined with the catalyst drop within the reaction chamber 241, i.e. before combined drop 222 exits the primary enclosure 241. The head construction is such that the nozzle outlets 213A, 213B are separated from each other by the separator 231, which does not allow the primary drops 221A, 221B to combine at the nozzle outlets 213A, 213B. Therefore, the ink and the catalyst will not mix directly at the nozzle outlets 213A, 213B, which prevents the nozzle outlets 213A, 213B from clogging. Once the drops are combined to a combined drop 222, there is no risk of clogging of the primary enclosure 241 at the connection point or downstream the enclosure 241, as the combined drop 222 is already separated from the nozzle outlets 213A, 213B and the stream of gas 271A, 271B (which preferably flows continuously) can effectively remove any residuals that would stick to the separator 231 or enclosure walls 241 before solidifying. The enclosure 241 guides the drops 221A, 221B, 222 towards its axis, therefore the drops 221A, 221B, 222 are guided in a controlled and predictable manner. It is therefore easy to control drop placement of the combined drop 222 on the surface to be printed. Even if, due to differences in size or density of the primary drops 221A, 221B, the combined drop 222 would tend to deviate from the axis of the primary enclosure 241, it will be aligned with its axis at the end of the enclosure 241, and therefore exit the enclosure 241 along its axis. Therefore, even relatively large-size drops and primary drops having different sizes can be combined due to the use of the primary enclosure 241 in a more predictable manner than in the prior art solutions where drops combine in-flight outside the printhead.

Therefore, the separator 231 and primary enclosure 241 function as a guide for the primary drops 221A, 221B within the reaction chamber from the nozzle outlet 213A, 213B to a connection point 232. The separator 231 and the first section 243 of the primary enclosure restrict the freedom of combination of primary drops 221A, 221B into a combined drop 222, i.e. the combined drop 222 forms to a shape and dimensions defined by the inlet of the first section 243, and the separator 231 and the first section 243 impact the further path of travel of the combined drop 222—downwards, towards the outlet of the first section 243. In other words, in the presented inkjet head, the drops 221A, 221B of at least two components, which before the combination have properties of stable liquids, are guided to a connection point 232 wherein they are still kept in contact with the components of the head, i.e. with the side walls of the first section 243 of the primary enclosure 241. Therefore, during combination and coalescence of the primary drops 221A, 221B, they are in contact with the head components.

The separator 231 may have the same properties as the separator 131 described for the first embodiment.

The inclination angles βA, βB of the nozzle channels 212A, 212B (which are in this embodiment also the ejection angles γB, γB at which the primary drops are ejected from the nozzle channels) as shown in FIGS. 4A and 4B are the same as the inclination angles αA, αB of the side walls of the separator 231, so that the primary drops 221A, 221B are ejected from the nozzles in parallel to the separator walls. In alternate embodiments, they may be larger than the corresponding inclination angles αA, αB of the separator walls, so that the ejected primary drops 221A, 221B are forced into contact with the separator walls.

However, an alternate embodiment is possible, wherein the inclination angles βA, βB of the nozzle channels 212A, 212B and the ejection angles γB, γB are smaller than the inclination angles αA, αB of the side walls of the separator 231, which may cause the ejected primary drops to separate from the side walls of the separator 231 and combine further downstream, i.e. below the tip of the separator. In such a case the separator 231 functions as a guide for the primary drops 221A, 221B only partially and its main function is to separate the nozzle outlets 213A, 213B so as to prevent them from clogging. In that case, it is mostly the stream of gas 271A, 271B formed by the inside walls of the preliminary enclosure 241 that acts this way (i.e. via moving gas) as means for guiding the primary drops 221A, 221B within the reaction chamber 241 from the nozzle outlet 213A, 213B to a connection point. The freedom of combination of primary drops 221A, 221B into the combined drop 222 at the connection point is then also restricted by the force of the stream of gas 271A, 271B formed by the internal walls of the primary enclosure 241.

The nozzles 212A, 212B shown in FIG. 4A are symmetrical, i.e. their angles of inclination βA, βB, and the ejection angles γB, γB are the same with respect to the axis of the head 200 or of the nozzle arrangement 210. In alternative embodiments, the nozzles 212A, 212B may be asymmetric, i.e. the angles βA, βB or γB, γB may be different, depending on the parameters of liquids supplied from the nozzle outlets 213A, 213B.

The inclination angles βA, βB and the ejection angles γB, γB can be from 0 to 90 degrees, preferably from 5 to 75 degrees, and more preferably from 15 to 45 degrees.

The primary enclosure 241 can be replaceable, which allows to assembly the head 210 with an enclosure 241 having parameters corresponding to the type of liquid used for printing. For example, enclosures 241 of different diameters D1 of the first section 243 can be used, depending on the actual features and size, as well as desired exit velocity of the combined drop 222. The angles of inclination βA, βB of the nozzles 211A, 211B can be adjustable, to adjust the nozzle assembly 210 to parameters of the liquids stored in the reservoirs 216A, 216B.

The first section 243 of the primary enclosure 241 has preferably a length L1 not shorter than the diameter dC of the combined drop 222, and preferably the length L1 equal to a few diameters dC of the combined drop 222, to set its path of movement precisely for precise drop placement control.

The internal surface of the primary enclosure 241, especially at the first section 243 and at the second section 244 has preferably a low friction coefficient and low adhesion in order to prevent the drops 221A, 221B, 222 or residuals of their combination from adhering to the surface, helping to keep the device clean and allow the eventual residuals to be blown off by the stream of gas 271A, 271B. Moreover, the internal walls of the primary enclosure 241 are inclined such as to provide a low contact angle between the side walls and the primary drops, which could accidentally hit the internal walls, such as to decrease adhesion and facilitate drop bouncing. In order to prevent any residue build-up side walls of the separator as well as primary enclosure are smooth with sharp edge endings, preferably covered in material having high contact angle to the primary drop liquid. The stream of gas preferably prevents also any particles from the outside environment to contaminate the inside of the primary enclosure 243.

The printing head may further comprise a secondary enclosure 251 which surrounds the primary enclosure 241 and has a shape corresponding to the primary enclosure 241 but a larger cross-sectional width, such that a second stream of gas 272, supplied from the pressurized gas inlet 219, can surround the outlet of the first section 243 of the primary enclosure 241, so that the combined drop 222 exiting the primary enclosure 241 is further guided downstream to facilitate control of its path. The gas stream 272 may further increase its velocity in the area of second outlet section 253 due to its shape and thus further accelerate the drop 222 exiting the primary enclosure 241. The surface of the cross section of the gas stream 272 decreases downwards which would cause the stream of gas 272 to reach the velocity not lower, but preferably higher than that of the combined drop 222 in the moment of leaving the section 243 of primary enclosure 241. In order to further increase the drop velocity the cross-section of the second outlet section 253 of the secondary enclosure 251, which is between the outlet of the primary enclosure and the first outlet section 252 of the secondary enclosure, is preferably decreasing downstream such as to direct the stream of gas 272 towards the central axis. The first outlet section 252 of the secondary enclosure 251 has preferably a round cross-section and a diameter D2 that is preferably larger (preferably, at least 2 times larger) than the diameter D1 of the outlet of the section 243 of the primary enclosure, such that the combined drop 222 does not touch the internal side all of the secondary enclosure 251 to prevent clogging and is guided by the (now combined) streams of gas 271A, 271B, 272 between the combined drop 222 and the side walls of the secondary enclosure 251. Moreover, the secondary enclosure may have perforations (openings) 255 in the first outlet section 252, to aid in decompression of the gas stream in a direction other than the flow direction of the combined drop. Preferably, the diameter D2 is at least 2 times greater than the diameter dC of the combined drop. Preferably, the length L2 of the first outlet section 252 is from zero to a multiple of diameters dC of the combined drop 222, such as 10, 100 or even 1000 times the diameter dC, in order to guide the drop in a controllable manner and provide it with desired kinetic energy. This may significantly increase the distance at which the combined drop 222 may be ejected from the printing head and still maintain the precise drop placement on the printed surface, which allows to print objects of variable surface. Moreover, this may allow to eject drops at an angle to the vector of gravity, while keeping satisfactory drop placement control. Moreover, relatively high length L2 may allow the combined drop to pre-cure before reaching the substrate 290.

In the outlet sections 252, 253 of the secondary enclosure 251 the gas increases its velocity thus decreasing its pressure and consequently lowering its temperature. This may cause the increase of velocity and the decrease of the temperature of the combined drop 222, which remains within the gas stream. Lowering the temperature of the combined drop 222 may increase its viscosity and adhesion, which is desirable in the moment of reaching the substrate by the drop helping the drop to remain in the target point and preventing it from flowing sidewise.

The second embodiment may further comprise a cover 281, having configuration and functionality as described for the cover 181 of the first embodiment, including the heating elements and temperature sensor (not shown for clarity of drawing).

Therefore, that embodiment can be used in drop on demand printing method to discharge the first primary drop 221A of the first liquid to move along the first path and to discharge the second primary drop 221B of the second liquid to move along the second path; and to control, by means of the surface of the separator (i.e. by means of a surface of a printing head element) and the streams of gas, the flight of the first primary drop 221A and the second primary drop 221B to combine the first primary drop 221A with the second primary drop 221B at the connection point 232 within the reaction chamber 241 within the printing head so that a chemical reaction is initiated within a controlled environment of the reaction chamber 241 between the first liquid of the first primary drop 221A and the second liquid of the second primary drop 221B. The path of flight of the combined drop 222 is controlled by means of the streams of gas 271A, 271B, 272A, 272B and by means of the surface of the printing head elements, namely the internal surface of the first section 243 primary enclosure 241.

Figure 4C:
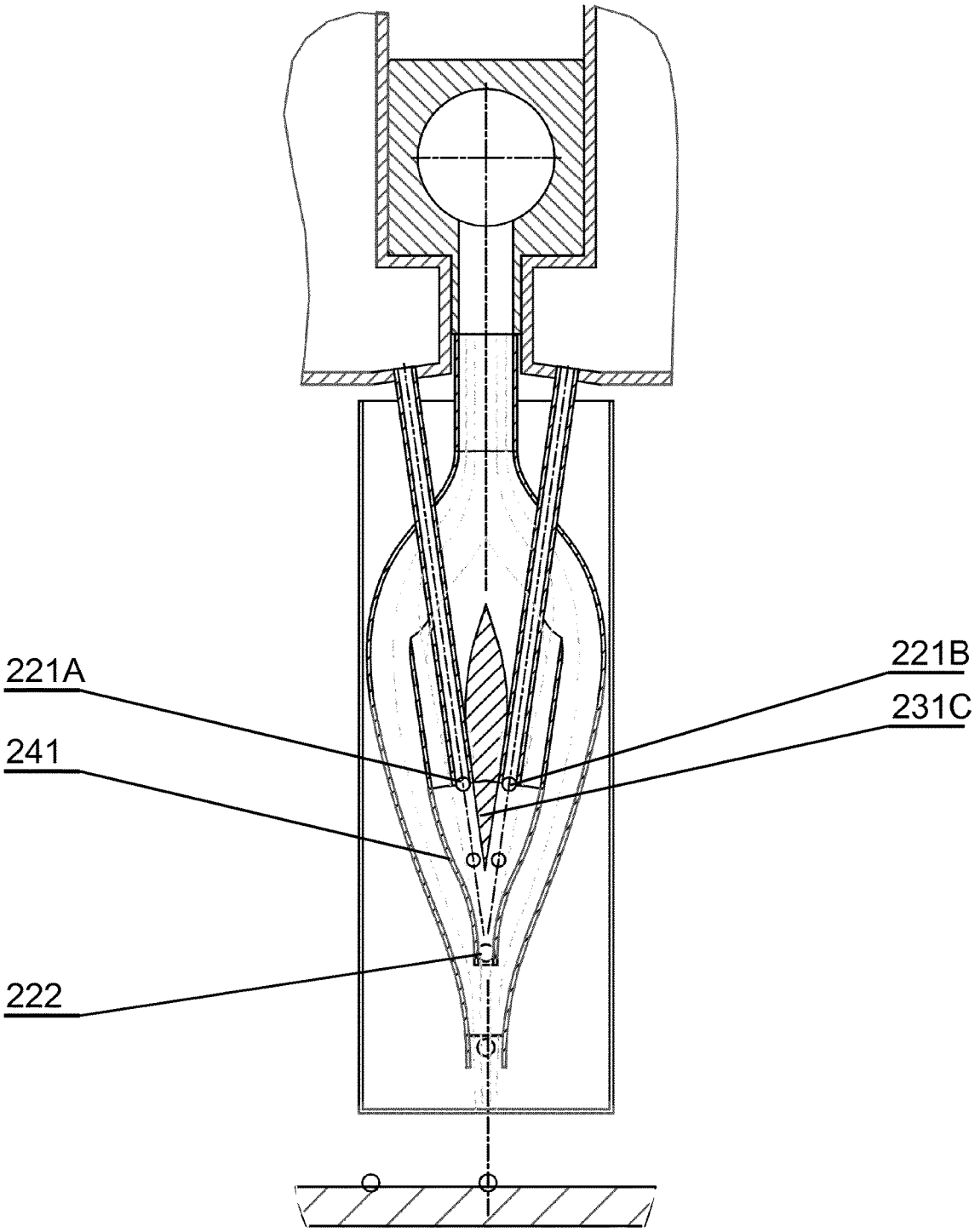
FIG. 4C shows schematically the second variant of the second embodiment of the invention.

The second variant of the second embodiment, as shown in FIG. 4C, differs from the first variant of FIG. 4A in that the side walls of separator 231C are slightly offset (not adjacent) from the internal side walls of the nozzle outlets, such that the primary drops 221A, 221B that are discharged are not immediately in contact with the side walls of the separator 231C. In that case, there is formed a thin layer of gas between the side walls of the separator 231C and the primary drops 221A, 221B. However, since the separator 231C restricts the freedom of gas flow and therefore the freedom of flow of the primary drops from the nozzle outlets towards the connection point, the separator 231C can be considered as indirectly guiding the primary drops. Similarly as to the variant of the first embodiment shown in FIG. 2E, it is mostly the downstream-narrowing tubular end of the primary enclosure 241 that restricts the freedom of combination of the primary drops into a combined drop 222 at the connection point and/or shapes the combined drop and aligns its output flow axis.

Third Embodiment

Figure 7:
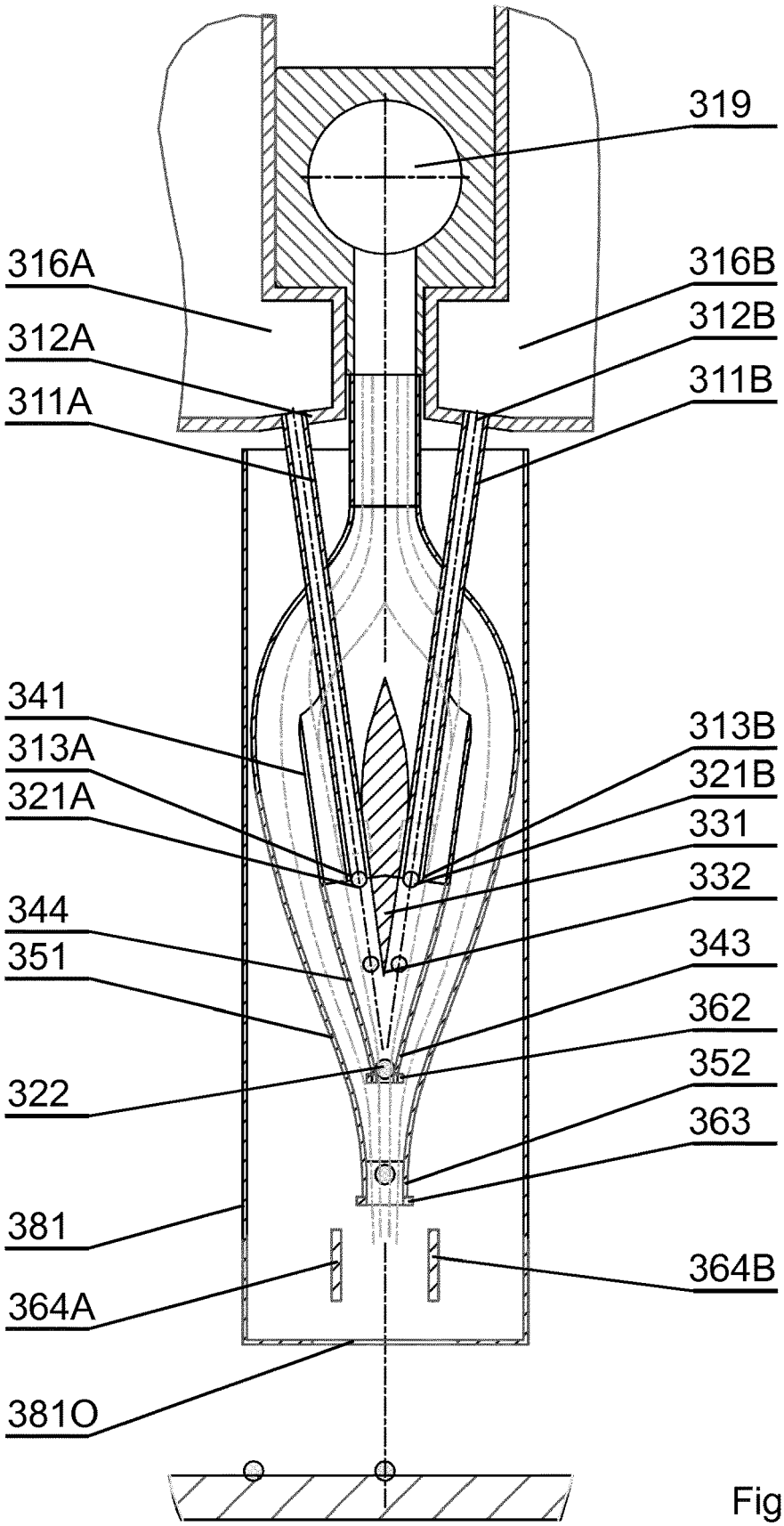
FIG. 7 shows schematically the third embodiment of the invention.

The third embodiment of the head 300 is shown schematically in a longitudinal cross-section on FIG. 7. It has most of its features in common with the second embodiment, with the following differences.

At the first section 343 of the primary enclosure 341 and at the first section 352 of the secondary enclosure 351, there are charging electrodes 362, 363 which apply electrostatic charge to the combined drop 322.

Moreover, downstream, behind at the first outlet section 352 of the secondary enclosure 351 there are deflecting electrodes 364A, 364B which deflect the direction of the flow of the charged drops 322 in a controllable direction. Thereby, the drop 322 placement can be effectively controlled. In order to allow change of the outlet path of the drops 322 from the inside of the head 300, the output opening 3810 of the cover 381 has an appropriate width so that the deflected drop 322 does not come into contact with the cover 381.

The charging electrodes 362, 363 and the deflecting electrodes 364A, 364B can be designed in a manner known in the art from CIJ technology and therefore do not require further clarification on details.

The other elements, having reference numbers starting with 3 (3xx) correspond to the elements of the second embodiment having reference numbers starting with 2 (2xx).

Fourth Embodiment

Figure 8:
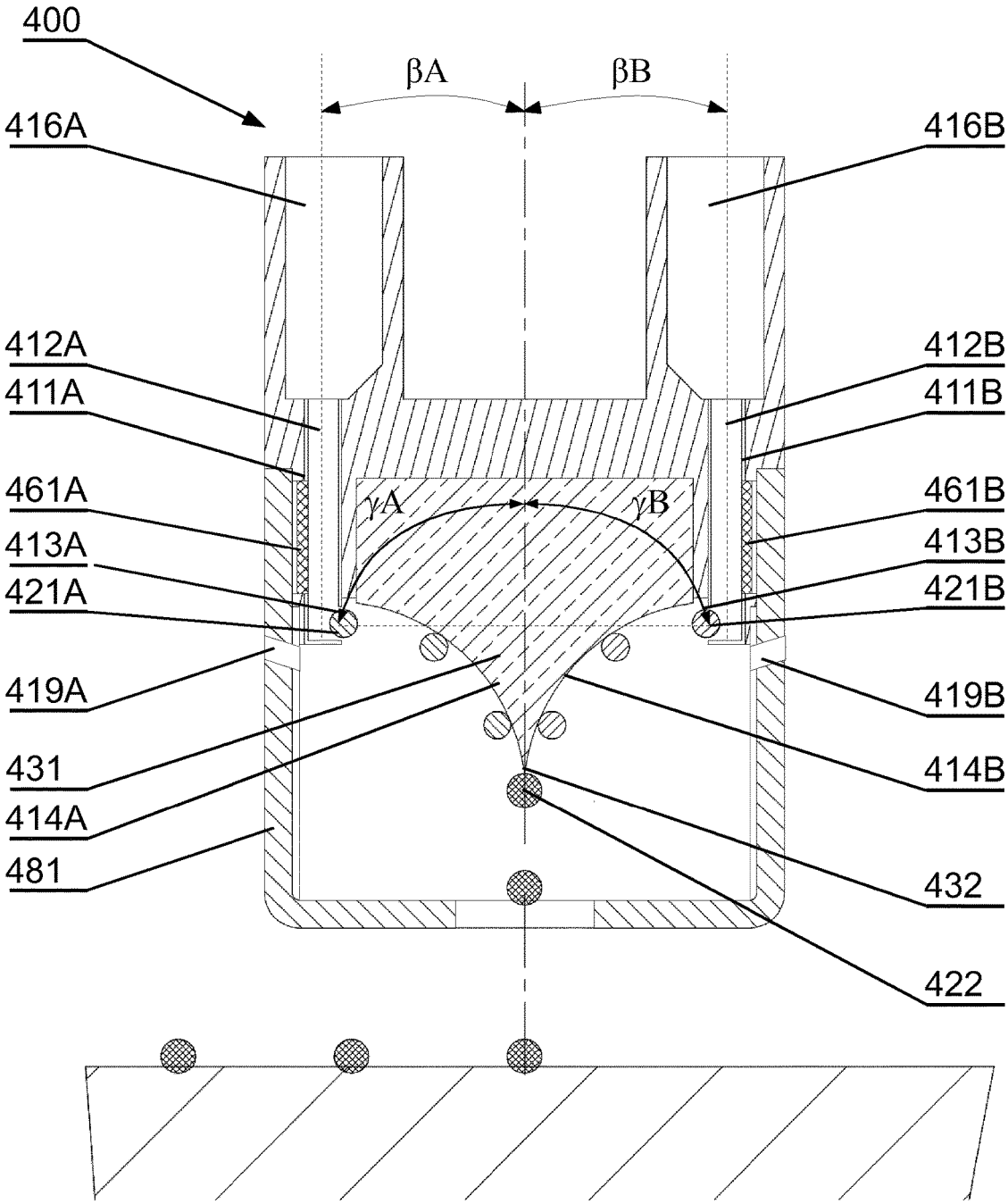
FIG. 8 shows schematically the fourth embodiment of the invention.

A fourth embodiment of the inkjet printing head 400 according to the invention is shown in FIG. 8 in a detailed cross-sectional view. Unless otherwise specified, the fourth embodiment shares common features with the first embodiment.

The inkjet printing head 400 may comprise one or more nozzle assemblies, each configured to produce a combined drop 422 formed of two primary drops 421A, 421B ejected from a pair of nozzles 411A, 411B separated by a separator 431. The embodiment can be enhanced by using more than two nozzles. Each nozzle 411A, 411B of the pair of nozzles in the nozzle assembly has a channel 412A, 412B for conducting liquid from a reservoir 416A, 416B. At the nozzle outlet 413A, 413B the liquid is formed into primary drops 421A, 421B as a result of operation drop generating and propelling devices 461A, 461B shown on FIGS. 10, 11, 12. The nozzle outlets 413A, 413B are separated by a separator 431 having a downstream-narrowing cross-section that separates the nozzle outlets 413A, 413B and thus prevents the undesirable contact between primary drops 421A and 421B prior to their full discharge from their respective nozzle outlets 413A and 413B.

The nozzles 412A, 412B have drop generating and propelling devices 461A, 461B for ejecting the drops to move respectively along a first path and a second path, which are only schematically marked in FIG. 8, and their schematically depicted types are shown in FIGS. 10-12. The drop generating and propelling devices may be for instance of thermal (FIG. 9), piezoelectric (FIG. 10) or valve (FIG. 11) type. In case of the valve the liquid would need to be delivered at adequate pressure.

The printing head further comprises a cover 481 which forms the reaction chamber and protects the head components, in particular the separator tip 432 and the nozzle outlets 413A, 413B, from the environment, for example prevents them from touching by the user or the printed substrate.

In the fourth embodiment, the ejection angles $\gamma$A, $\gamma$B at which the primary drops 421A, 421B are ejected from the nozzle channels 412A, 412B are equal to 90 degrees, i.e. the primary drops 421A, 421B are ejected along the first path and the second path that are initially arranged perpendicularly to the longitudinal axis of the head. In this embodiment, the nozzle inclination angles $\beta$A, $\beta$B are equal to 0 degrees, i.e. the nozzle channels are parallel to the longitudinal axis of the head, but in other embodiments they can be different. Next, the ejected primary drops 421A, 421B are guided along the separator 431, which has concave side walls 414A, 414B, towards its tip 432, where they combine to form a combined drop 422, which separates from the separator tip 432 and travels towards the surface to be printed. In this embodiment it is the geometry of the separator, and not of the nozzles, that determines collision parameters of the primary drops allowing for full coalescence. Therefore, the separator 431 functions as means for controlling the flight of the first primary drop 421A and the second primary drop 421B, and in particular for altering the first path and the second path before the connection point, to allow the first primary drop 421A to combine with the second primary drop 421B at the connection point 432 into the combined drop 422 within the reaction chamber 481.

Nozzles 419A, 419B generate streams of gas that facilitate guiding the primary drops along the separator 431 and then control the path of flight of the combined drop 422.

The separator can be exchangeable, allowing for the modification of collision parameters. Furthermore, drops being formed from the nozzles are guided along the side walls of the separator and outside the printing head also by means of the stream of gas flowing alongside the path of the primary drops and—from the connection point—alongside the path of the combined drop. The stream of gas increases the control of the drops flight, increases their energy and has yet another objective: any undesired residue of liquids will be removed from the separator walls, reaction chamber and the nozzle by this stream of gas.

Therefore, that embodiment can be used in drop on demand printing method to discharge the first primary drop 421A of the first liquid to move along the first path and to discharge the second primary drop 421B of the second liquid to move along the second path; and to control, by means of the separator and the streams of gas, the flight of the first primary drop 421A and the second primary drop 421B to combine the first primary drop 421A with the second primary drop 421B at the connection point 432 within the reaction chamber 481 within the printing head so that a chemical reaction is initiated within a controlled environment of the reaction chamber 481 between the first liquid of the first primary drop 421A and the second liquid of the second primary drop 421B. The path of flight of the combined drop 222 is controlled by means of the streams of gas from gas nozzles 419A, 419B.

Fifth Embodiment

Figure 12A:
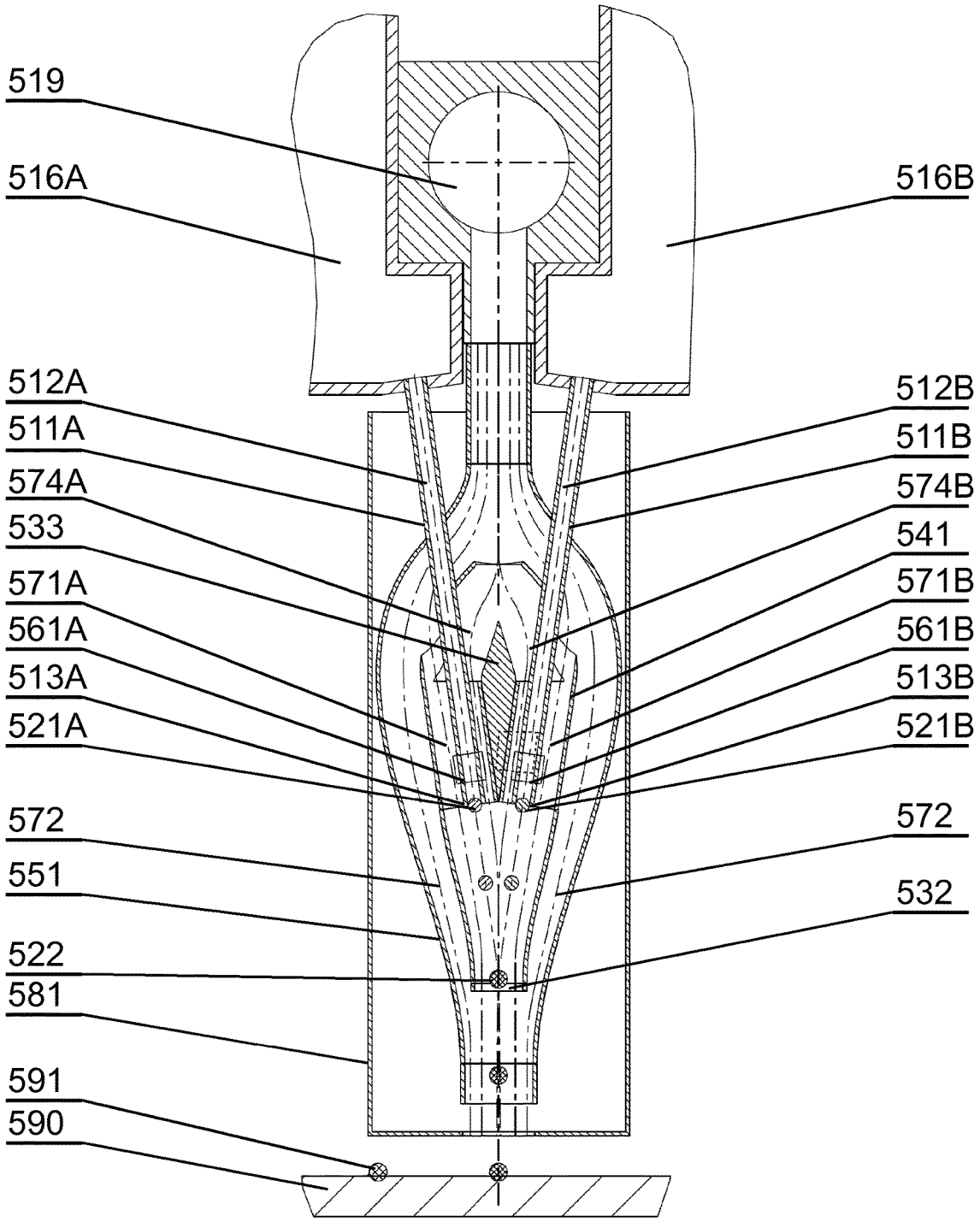
FIG. 12A shows schematically the first variant of a fifth embodiment of the invention.

The fifth embodiment of the head 500 is shown in an overview, in a first variant, in FIG. 12A. The fifth embodiment 500 has most of its features in common with the second embodiment, with the main difference such that it does not comprise the separator 231.

The primary drops 521A, 521B ejected from the nozzle outlets 513A, 513B move along respectively a first path and a second path towards a connection point 532, where they combine to form a combined drop 522 and travels towards the surface to be printed.

The primary drops 521A, 521B are guided by streams 571A, 571B and 574A, 574B of gas (such as air or nitrogen, provided from a pressurized gas input 519 (e.g. a gas supplying nozzle)) inside primary enclosure 541. The shape of the primary enclosure 541 in its upper part helps to direct the stream of gas alongside the nozzles 511A, 511B and guides drops from the outlets 513A, 513B of the nozzles 511A, 511B towards the connection point at which they join to form the combined drop 522.

Therefore, the streams 571A, 571B of gas function as means for controlling the flight of the first primary drop 521A and the second primary drop 521B to allow the first primary drop 521A to combine with the second primary drop 521B at the connection point 532 into the combined drop 522.

The chemical reaction is initiated at the connection point 532 (at which the first path crosses with the second path) within a reaction chamber, which is in this embodiment formed by the primary enclosure 541.

The nozzles 511A, 511B can be separated by a blocking element 533 (which is however separate from the nozzles 511A 511B), such that streams of gas 571A, 571B may form between the nozzles 511A, 511B and the primary enclosure 541 and streams of gas 574A, 574B may form between the nozzles 511A, 511B and the blocking element 533.

Alternatively, the head may have no blocking element 533, then the streams of gas 574A, 574B will not be directed in parallel to the axes of the nozzles 511A, 511B. However, due to the directions of streams 571A, 571B, the control over path of movement of the primary drops 521A, 521B may still be possible.

The nozzle outlets 513A, 513B may be heated to a temperature higher than the temperature of the environment. The liquids in the reservoirs 516A, 516B may be also preheated. Increased temperature of working fluids (i.e. the first liquid and the second liquid) may also lead to improved coalescence process of primary drops and preferably increase adhesion and decrease the curing time of the combined drop 522 when applied on the substrate.

The other elements, having reference numbers starting with 5 (5xx) correspond to the elements of the second embodiment having reference numbers starting with 2 (2xx).

Therefore, that embodiment can be used in drop on demand printing method to discharge the first primary drop 521A of the first liquid to move along the first path and to discharge the second primary drop 521B of the second liquid to move along the second path; and to control, by means of the streams of gas 571A, 571B, the flight of the first primary drop 521A and the second primary drop 521B to combine the first primary drop 521A with the second primary drop 521B at the connection point 532 within the reaction chamber 541 within the printing head so that a chemical reaction is initiated within a controlled environment of the reaction chamber 541 between the first liquid of the first primary drop 521A and the second liquid of the second primary drop 521B. The path of flight of the combined drop 522 is controlled by means of the streams of gas 571A, 571B, 572.

Figure 12B:
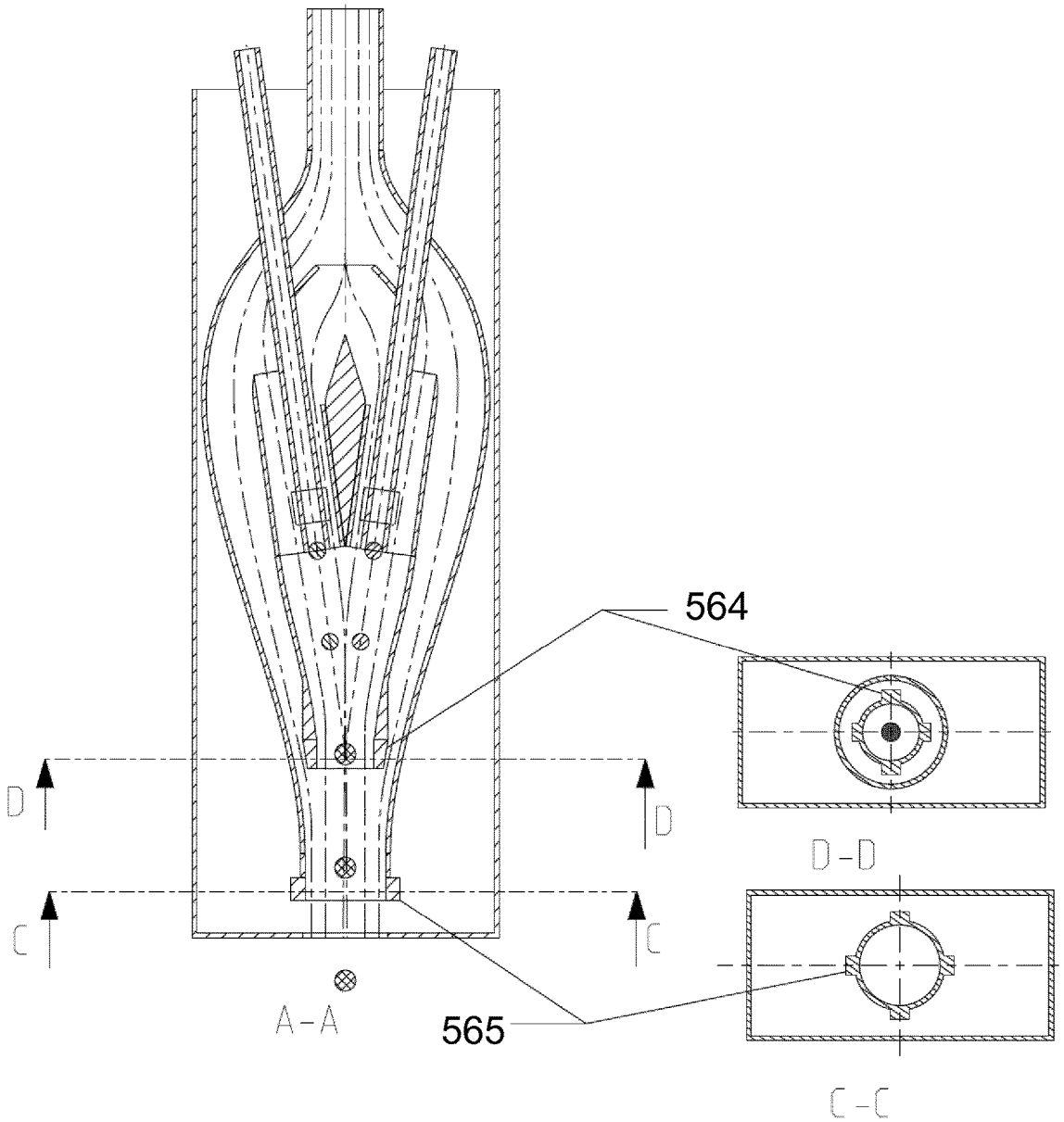
FIG. 12B shows schematically the second variant of the fifth embodiment of the invention.

In a second variant of the fifth embodiment, shown schematically in FIG. 12B, one or both of the liquids stored in liquid reservoirs 516A, 516B may be pre-charged with a predetermined electrostatic charge, such that one or both of the primary drops exiting the nozzle outlets are charged, which may facilitate combination of primary drops 521A, 521B to a combined drop 522. As shown in FIG. 12B, the outlet of the primary enclosure 541 may contain a set of electrodes 564, which generate electrical field that forces the charged combined drop 522 to be aligned with the longitudinal axis of the head. Moreover, the outlet of the secondary enclosure 551 may contain a set of electrodes 565, which generate electrical field that forces the charged combined drop 522 to be aligned with the longitudinal axis of the head. Both or only one of the electrodes set 564, 565 may be used. Preferably, the sets 564, 565 each comprise at least 3 electrodes, or preferably 4 electrodes, which are distributed evenly along the circumference of a circle, such as to force the drop 522 towards the central axis. Therefore, the sets of electrodes 564, 565 aid in drop placement. The other elements are equivalent to the first variant.

Figure 12C:
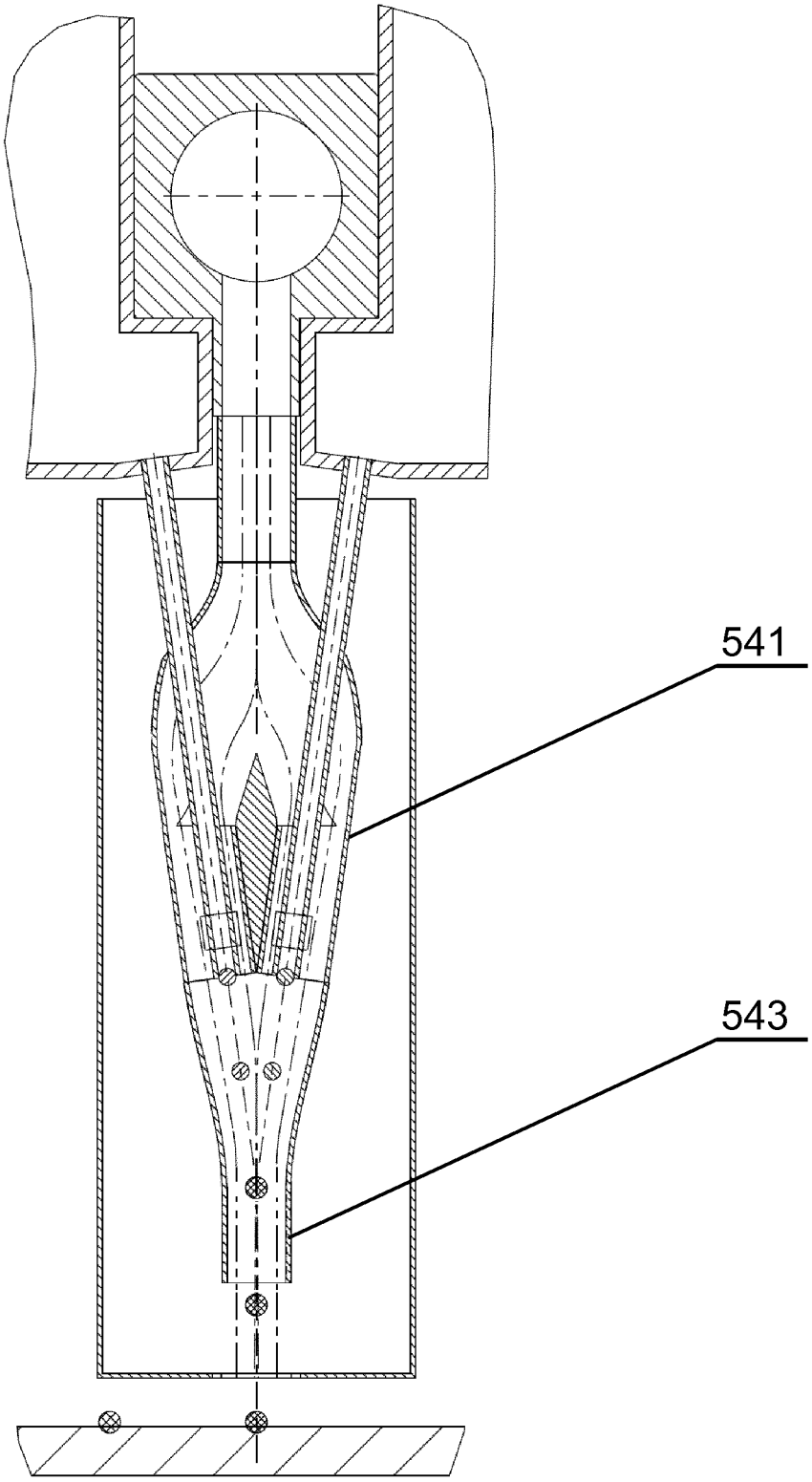
FIG. 12C shows schematically the third variant of the fifth embodiment of the invention.

In a third variant of that embodiment, shown schematically in FIG. 12C, only the primary enclosure 541 is present, without the secondary enclosure 551. The primary enclosure 541 has a longer first section 543 as compared to the first variant, which facilitates control over drop placement and may allow to increase the energy of the outlet combined drop. The other elements are equivalent to the first variant.

Figure 12D:
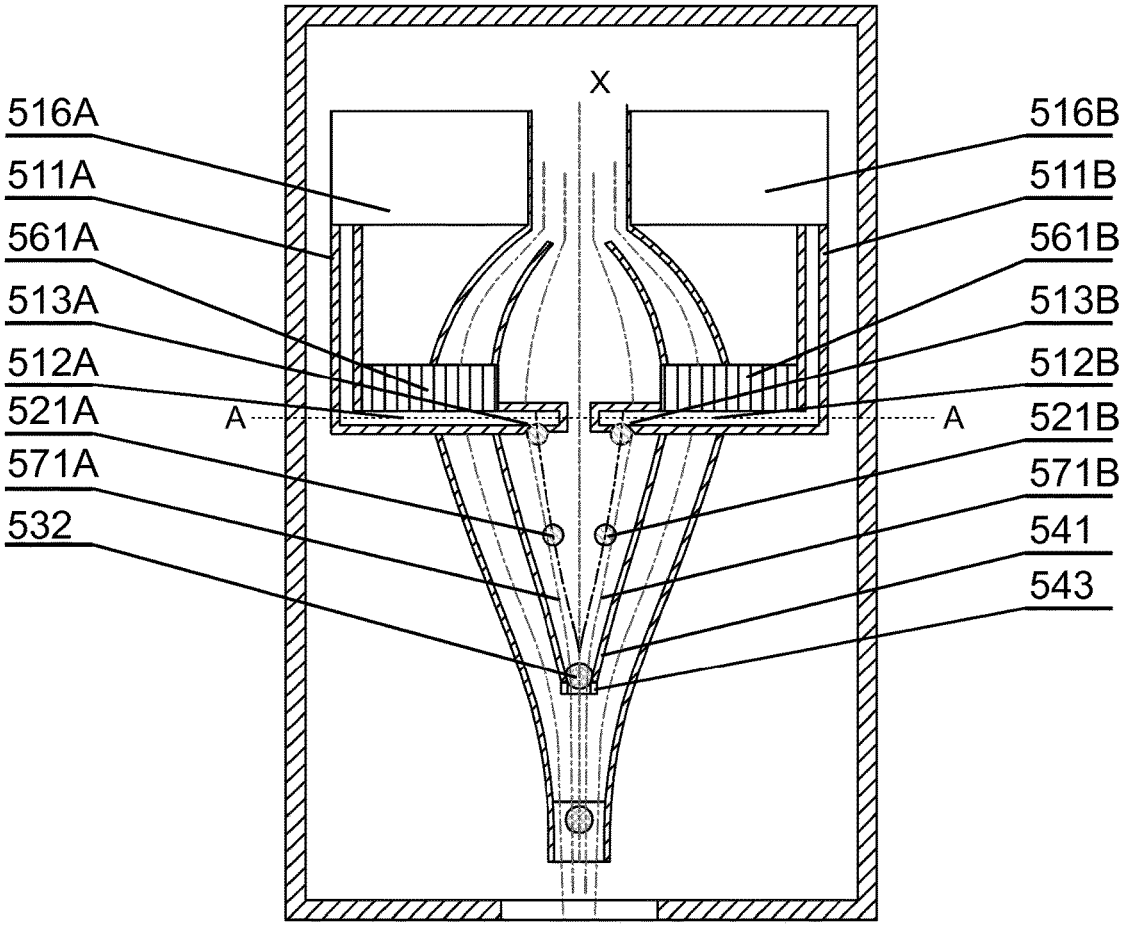
FIG. 12D-12F shows schematically the fourth variant of the fifth embodiment of the invention.
Figure 12E:
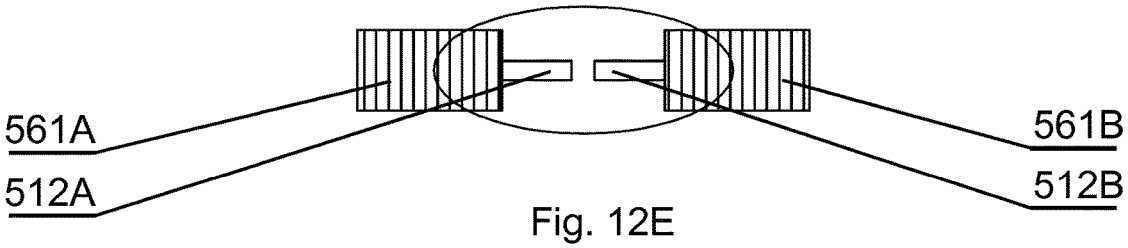
Figure 12F:
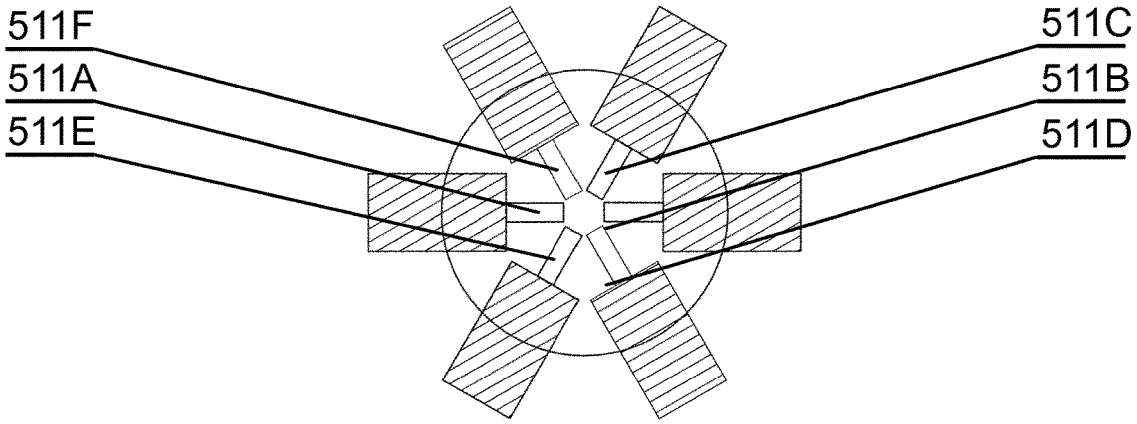

The fourth variant of that embodiment, shown schematically in FIGS. 12D and 12E, 12F (which are schematic cross-sections along the line A-A of FIG. 12D), differs from the first variant of FIG. 12A by the following. The nozzles 511A, 511B have the end sections of their channels 512A, 512B arranged substantially perpendicularly to the main axis of the printing head) and the nozzle outlets 513A, 513B are configured to eject the primary drops 521A, 521B such that they move along respectively a first path and a second path which are initially directed in parallel to the main axis X of the printing head.

Such arrangement of the end sections of the nozzle channels 512A, 512B further allows to position relatively large (for example, piezoelectric) drop generating and propelling devices 561A, 561B, as shown in FIG. 12E.

FIG. 12F shows another variant, with a possibility to implement more than two (e.g. six) nozzles 512A-512F, each having its own drop generating and propelling device 561A-561F, each connected to an individual liquid reservoir, in order to allow generation of a combined drop from more than two primary drops. It shall be noted that in such case not all combined drops have to be combined from six drops, it is possible that for a particular combined drop only some of the nozzles 512A-512F provide primary drops, e.g. two, three, four or five nozzles, depending on the desired properties of the combined drop.

After being ejected, the primary drops 521A, 521B are guided by the streams of gas 571A, 571B within the primary enclosure 541, such that the first path and the second path are changed to cross each other at the connection point 532, which is located preferably at the downstream section 543 of the primary enclosure 541, which has preferably a constant, round cross-section of a diameter substantially equal to the desired diameter of the combined drop 522, and may be further configured such as described with respect to the section 243 of the second embodiment as shown in FIGS. 4A-4B.

Figure 12G:
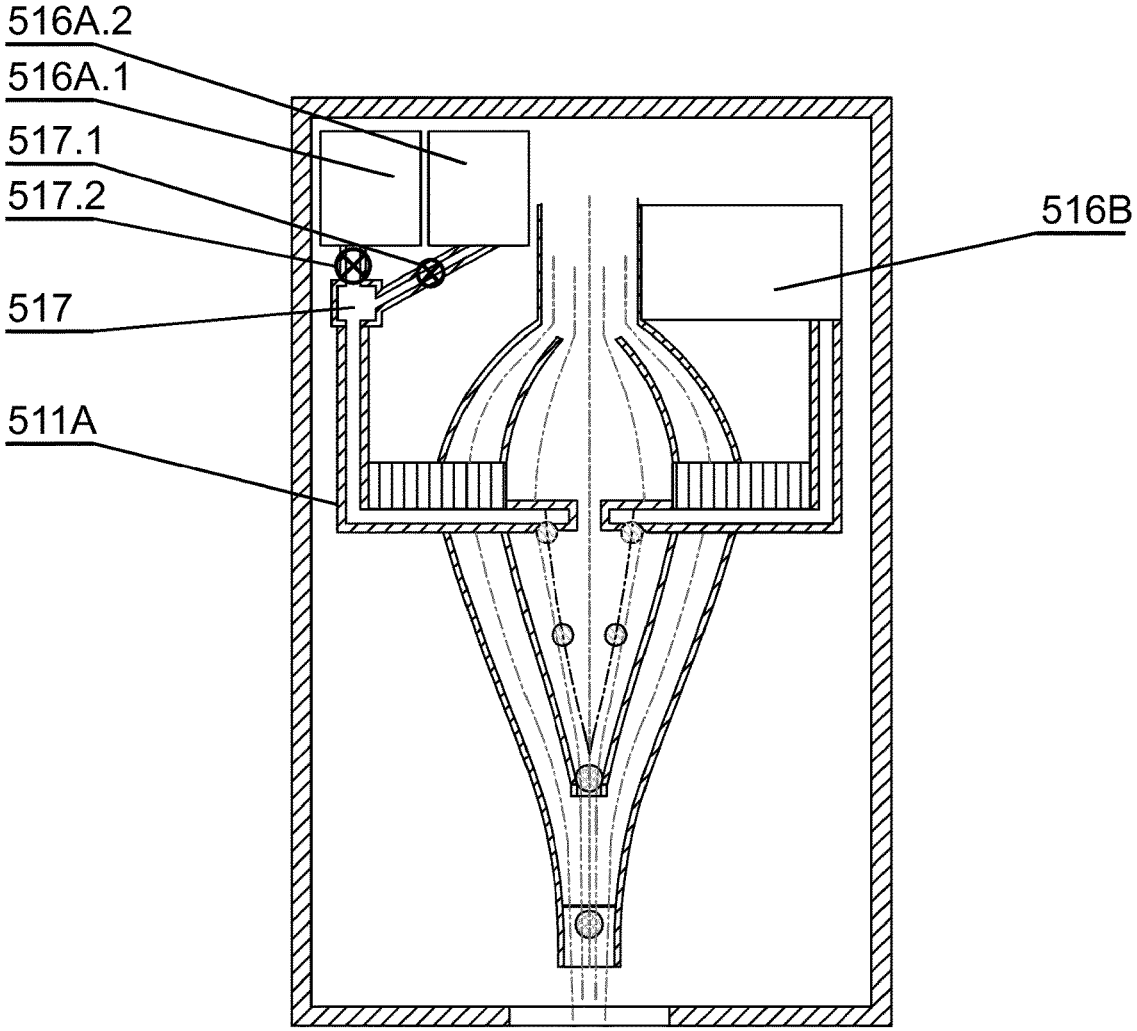
FIG. 12G shows schematically the fifth variant of the fifth embodiment of the invention.

The fifth variant of that embodiment, shown schematically in FIG. 12G, differs from the first variant of FIG. 12A by the following. At least one of the nozzles, in that example the first nozzle 511A, is connected to a mixing chamber 517, wherein liquid is mixed from a plurality of reservoirs 516A1, 516A2, from which the liquid is dosed by valves 517.1, 517.2. For example, the separate reservoirs 516A1, 516A2 may store inks of different colors, in order to supply from the first nozzle 511A a primary drop of ink having a desired color.

Figure 12H:
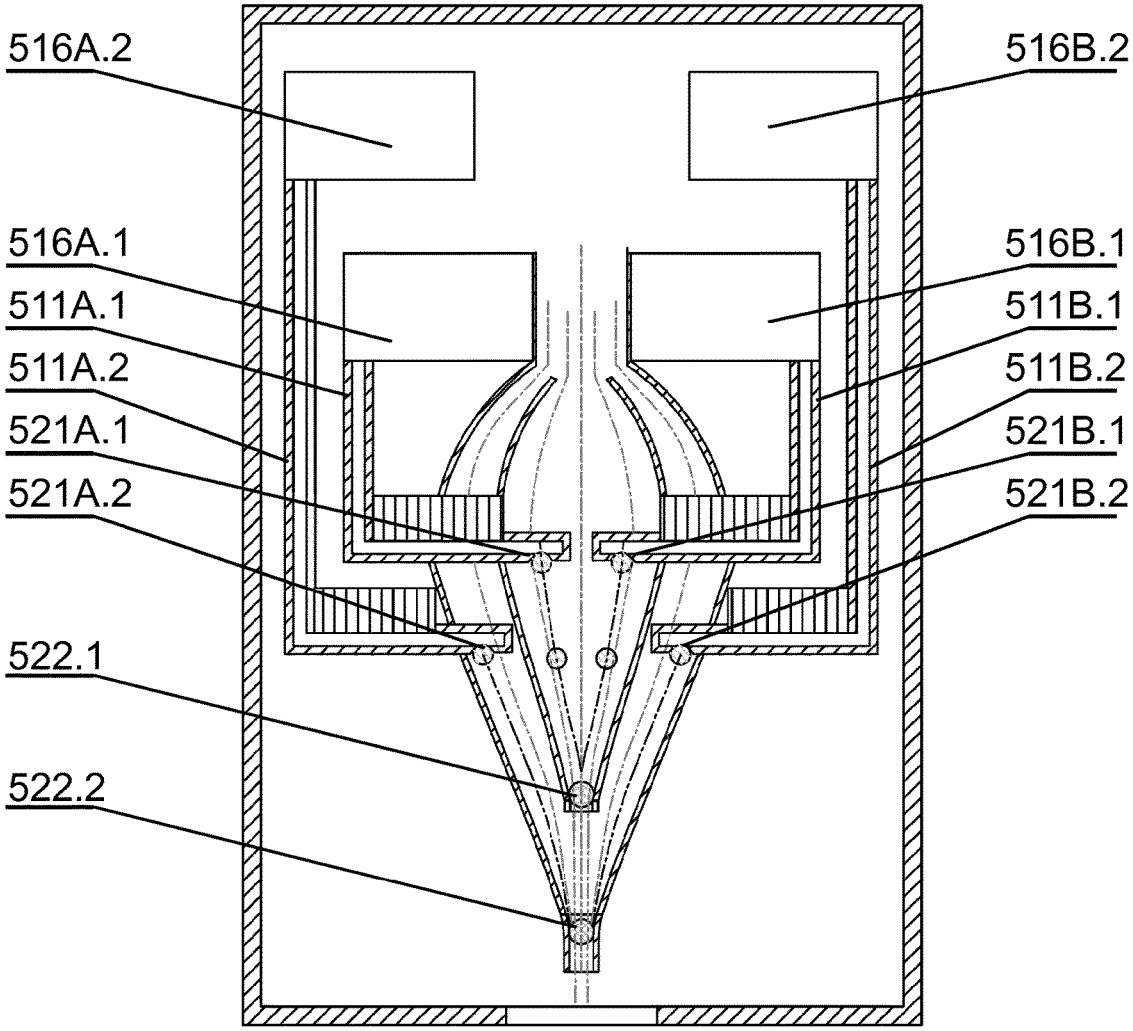
FIG. 12H shows schematically the sixth variant of the fifth embodiment of the invention.

The sixth variant of that embodiment, shown schematically in FIG. 12H, differs from the fourth variant of FIG. 12D-12F by the following. The nozzles are arranged in a plurality of levels. The first level of nozzles 511A.1, 511B.1 (connected to liquid reservoirs 516A.1, 516B.1) is arranged such that they produce first level primary drops 121A.1, 121B.1 within the primary enclosure 541, which are guided by the streams of gas to combine into a first level combined drop 122.1. The second level of nozzles 511A.2, 511B.2 (connected to liquid reservoirs 516A.2, 516B.2) is arranged such that they produce second level primary drops 121A.2, 121B.2 within the secondary enclosure 551, which are guided by the streams of gas to combine into a second level combined drop 122.2. The second level combined drop 122.1 may be formed of only the second level primary drops 121A.2, 121B.2 (which allows to increase the drop generation frequency or variety of drop types that can be generated) or may be formed of the second level primary drops 121A.2, 121B.2 combined with the first level combined drop 122.1 (which allows to increase the variety of drop types from more than two components that can be generated).

Sixth Embodiment

Figure 13:
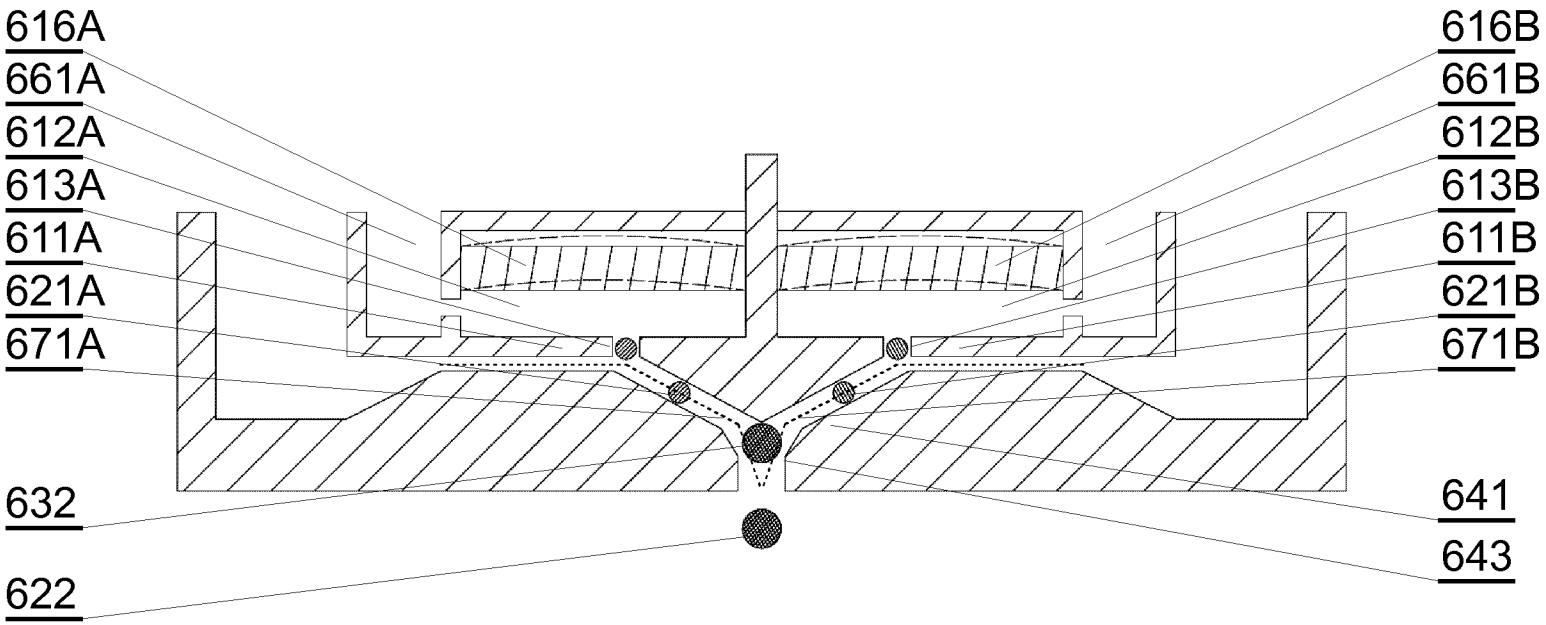
FIG. 13 shows schematically a printing head according to an sixth embodiment.

The sixth embodiment of the head 600 is shown in an overview in FIG. 13. The sixth embodiment 600 is adapted particularly for use with large-size drop generating and propelling devices.

The primary drops 621A, 621B are ejected from the nozzle outlets 613A, 613B of nozzles 611A, 611B which preferably have at least the end sections of their channels 612A, 612B arranged substantially perpendicularly to the main axis X of the printing head. The nozzle channels 612A, 612B may accommodate large-size (e.g. piezoelectric) drop generating and propelling devices 661A, 661B. The primary drops 621A, 621B are formed of a first liquid and second liquid from the reservoirs 616A, 616B.

The primary drops 621A, 6211B are ejected to move along respectively the first and second path, which are initially arranged substantially in parallel to the main axis X. The primary drops 621A, 621B are then guided within a primary enclosure 641 (which functions as the reaction chamber) by streams of gas 671A, 671B which may be generated within the primary enclosure 641 from appropriate gas source, e.g. a gas supplying nozzle. The primary enclosure 641 has a downstream-narrowing cross section. The outlet section 643 of the primary enclosure 641 has preferably a constant, round cross-section of a diameter substantially equal to the desired diameter of the combined drop 622, and may be further configured such as described with respect to the section 243 of the second embodiment as shown in FIGS. 4A-4B.

Therefore, that embodiment can be used in drop on demand printing method to discharge the first primary drop 621A of the first liquid to move along the first path and to discharge the second primary drop 621B of the second liquid to move along the second path; and to control, by means of the shape of the channel of primary enclosure 641 and streams of gas 671A, 671B, the flight of the first primary drop 621A and the second primary drop 621B to combine the first primary drop 621A with the second primary drop 621B at the connection point 632 within the reaction chamber 641 within the printing head so that a chemical reaction is initiated within a controlled environment of the reaction chamber 641 between the first liquid of the first primary drop 621A and the second liquid of the second primary drop 621B. The path of flight of the combined drop 622 is controlled by means of the streams of gas 671A, 671B.

Further Embodiments

It shall be noted that the drawings are schematic and not in scale and are used only to illustrate the embodiments for better understanding of the principles of operation.

The present invention is particularly applicable for high resolution DOD inkjet printers. However, the present invention can be also applied to low resolution DOD based on valves allowing to discharge drops of pressurized ink.

The environment in the reaction chamber may be controlled by controlling at least one of the following parameters: chamber temperature (e.g. by means of a heater within the reaction chamber), velocity of the streams of gas (e.g. by controlling the pressure of gas delivered), gas components (e.g. by controlling the composition of gas delivered from various sources), electric field (e.g. by controlling the electrodes), ultrasound field (e.g. by providing additional ultrasound generators within the reaction chamber, not shown in the drawings), UV light (e.g. by providing additional UV light generators within the reaction chamber, not shown in the drawings), etc.

A skilled person will realize that the features of the embodiments described above can be further mixed between the embodiments. For example there can be more than two nozzles directing more than two primary drops in order to form one combined drop by means of using the same principles of discharging, guiding, forming, also by means of controlled coalescence, and accelerating drops within the print head as described above.

The invention claimed is:

1. A method, for performing drop on demand printing in a printing head, comprising:

discharging a first primary drop of a first liquid to move along a first path;

discharging a second primary drop of a second liquid to move along a second path;

controlling flight of the first primary drop and the second primary drop to combine the first primary drop with the second primary drop into a combined drop at a connection point within a reaction chamber within the printing head so that a chemical reaction is initiated within a controlled environment of the reaction chamber between the first liquid of the first primary drop and the second liquid of the second primary drop; and controlling the flight of the combined drop at least via a stream of gas provided from at least one gas-supplying nozzle.

2. The method according to claim 1, further comprising controlling the flight of the combined drop via a surface of one or more elements of the printing head.

3. The method according to claim 1, further comprising controlling the flight of the first primary drop and the second primary drop at least by guiding the combined drop along the stream of gas.

4. The method according to claim 1, further comprising controlling the flight of the first primary drop and the second primary drop by guiding the first primary drop along a surface of one or more elements of the printing head.

5. The method according to claim 1, further comprising controlling at least one of the following parameters within the reaction chamber: chamber temperature, gas velocity, gas temperature, gas components, electric field, ultrasound field, and UV light.

6. The method according to claim 1, wherein the stream of gas controlling the flight of the combined drop is intermittent and generated for at least the time of flight of the combined drop through the printing head from the connection point in the reaction chamber to an outlet of the printing head.

7. The method according to claim 1, wherein the stream of gas controlling the flight of the combined drop is generated in a continuous manner.

8. The method according to claim 1, wherein the streams of gas have a temperature higher than a temperature ambient to the printing head.

9. The method according to claim 1, wherein the first liquid is an ink base and the second liquid is a catalyst for curing the ink base.

10. A drop-on-demand printing head comprising:

a nozzle assembly comprising:

a first nozzle connected through a first channel with a first liquid reservoir with a first liquid and having a first drop generating and propelling device for forming on demand a first primary drop of the first liquid and discharging the first primary drop to move along a first path; and a second nozzle connected through a second channel with a second liquid reservoir with a second liquid and having a second drop generating and propelling device for forming on demand a second primary drop of the second liquid and discharging the second primary drop to move along a second path;

a reaction chamber;

wherein the first path crosses with the second path within the reaction chamber at a connection point;

means for controlling the flight of the first primary drop and the second primary drop and configured to allow the first primary drop to combine with the second primary drop at the connection point into a combined drop so that a chemical reaction is initiated within a controlled environment of the reaction chamber between the first liquid of the first primary drop and the second liquid of the second primary drop; and at least one gas-supplying nozzle configured to supply gas for controlling flight of the combined drop.

11. The printing head according to claim 10, further comprising elements configured to control the flight of the combined drop along a surface of the elements.

12. The printing head according to claim 10, further comprising at least one gas-supplying nozzle configured to supply gas for controlling the flight of the first primary drop and the second primary drop.

13. The printing head according to claim 10, further comprising elements configured to control the flight of the first primary drop and the second primary drop along a surface of the elements.

14. The printing head according to claim 10, further comprising means for restricting the freedom of combination of the primary drops into the combined drop.

15. The printing head according to claim 10, wherein the first liquid is an ink base and the second liquid is a catalyst for curing the ink base.

* * * * *